US005733702A

United States Patent [19]

Okado et al.

[11] Patent Number: 5,733,702

[45] Date of Patent: Mar. 31, 1998

[54] IMAGE FORMING METHOD EMPLOYING TONER WITH EXTERNAL ADDITIVE

[75] Inventors: Kenji Okado, Yokohama; Toshiyuki Ugai, Tokyo; Ryoichi Fujita; Tsuyoshi Takiguchi, both of Kawasaki; Yasuhiro Ichikawa, Tokyo, all of Japan

[73] Assignee: Canon Kabushiki Kaisha, Tokyo, Japan

[21] Appl. No.: 417,227

[22] Filed: Apr. 5, 1995

Related U.S. Application Data

[62] Division of Ser. No. 395,645, Feb. 28, 1995, Pat. No. 5,637,432, which is a continuation of Ser. No. 69,380, Jun. 1, 1993, abandoned.

[30] Foreign Application Priority Data

Jun. 1, 1992 [JP] Japan ..... 4-163398

[51] Int. Cl.[6] ..... G03G 21/00

[52] U.S. Cl. ..... 430/125; 430/110; 430/111

[58] Field of Search ..... 430/125, 110, 430/111

[56] References Cited

U.S. PATENT DOCUMENTS

| | | | |
|---|---|---|---|
| 3,942,979 | 3/1976 | Jones et al. | 96/1 SD |
| 3,969,251 | 7/1976 | Jones et al. | 252/62.1 P |
| 4,122,024 | 10/1978 | Jones et al. | 252/62.1 P |
| 4,904,555 | 2/1990 | Nagatsuka et al. | 430/122 |
| 4,933,251 | 6/1990 | Ichimura et al. | 430/111 |
| 5,039,598 | 8/1991 | Abramsohn et al. | 430/53 |
| 5,073,434 | 12/1991 | Frank et al. | 430/903 |
| 5,077,169 | 12/1991 | Inoue et al. | 430/110 |
| 5,077,170 | 12/1991 | Tsujihiro | 430/110 |
| 5,139,914 | 8/1992 | Tomiyama et al. | 430/106.6 |
| 5,219,697 | 6/1993 | Mori et al. | 430/110 |
| 5,450,184 | 9/1995 | Yanai et al. | 355/299 |

FOREIGN PATENT DOCUMENTS

| | | |
|---|---|---|
| 51-3244 | 1/1976 | Japan . |
| 52-32256 | 8/1977 | Japan . |
| 54-45135 | 4/1979 | Japan . |
| 54-72054 | 6/1979 | Japan . |
| 57-129437 | 8/1982 | Japan . |
| 59-52255 | 3/1984 | Japan . |
| 60-32060 | 2/1985 | Japan . |
| 60-136752 | 7/1985 | Japan . |

OTHER PUBLICATIONS

Patent Abstract of Japan, vol. 14, No. 415 (P1102) [4358] Sep. 7, 1990 (JP2-160251).

*Primary Examiner*—George F. Lesmes
*Assistant Examiner*—Laura Weiner
*Attorney, Agent, or Firm*—Fitzpatrick, Cella, Harper & Scinto

[57] ABSTRACT

An image forming method is conducted by forming a toner image on a latent image bearing member containing an organic photoconductive material. The latent image bearing member includes a photosensitive layer containing an organic photoconductive material and a protective layer which contains fluorine-containing resin particles in an amount from 5% by weight to 40% by weight. The toner contains toner particles and external additives. The external additives include titanium oxide particles having a weight average particle diameter from 0.01 μm to 0.2 μm having been subjected to hydrophobic treatment, organic resin particles having a weight average particle diameter from 0.02 μm to 0.5 μm, and inorganic compound particles having a weight average particle diameter from 0.5 μm to 2.5 m.

The inorganic compound particles may be specific titanates, oxides or carbonate. The external additives are added in an amount satisfying the relationship:

$(A):(B)=2:1$ to $10:1$ $(A):(C)=1:1$ to $5:1$

The toner contains toner particles having a particle diameter from 2 μm to 5 μm in an amount from 15% by number to 40% by number. The toner image is transferred to a transfer medium and the latent image bearing member is then cleaned.

145 Claims, 1 Drawing Sheet

IMAGE FORMING METHOD EMPLOYING TONER WITH EXTERNAL ADDITIVE

This application is a division of application Ser. No. 08/395,645 filed Feb. 28, 1995, now U.S. Pat. No. 5,637, 432, which in turn, is a continuation of application Ser. No. 08/069,380, filed Jun. 1, 1993, now abandoned.

BACKGROUND OF THE INVENTION

1. Field of the Invention

The present invention relates to an image forming method in which a latent image is formed on a photosensitive member which contains an organic photoconductive material (hereinafter "OPC photosensitive member") and serves as a latent image bearing member, said latent image is developed with a toner, and the developed image is transferred to a transfer medium to obtain a visible image, and then the latent image bearing member is cleaned after the transfer by means of a cleaning member for repeating use. It also relates to a toner for developing an electrostatic image, suited to such a method.

2. Related Background Art

In recent years, various electrophtographic image forming apparatus such as color copying machines and printers making use of OPC photosensitive members as a latent-image bearing member are produced. In such an image forming apparatus, usually a latent image is formed on an OPC photosensitive member by a usual electrophotographic process, the latent image is developed by a developing assembly to form a developed (toner) image, and the developed image is transferred to a transfer medium to obtain a visible image. Meanwhile, the residual developed image on the latent-image bearing member is cleaned by means of a cleaning member, and the latent-image bearing member is repeatedly used.

As the cleaning means, a blade-cleaning means comprising pressing a cleaning blade made of an elastic rubber material to the latent-image bearing member, is very popular because of its simple and compact construction and cost effectiveness.

In general, an OPC photosensitive member comprises a conductive support and, provided thereon in the following order, a charge generation layer comprising a binder and dispersed charge-generating material and a charge transport layer comprising a binder and dispersed charge-transporting material. As a charge-generating material, pigments such as phthalocyanine pigments, anthrone pigments, azo pigments and indigo pigments or dyes such as cyanine dyes are used. As the charge-transporting material, carbazoles such as pyrene and isopropylcarbazole, hydrazones, pyrazolines, oxazonyl compounds, thiazole compounds, triarylmethane compounds and polyarylalkane compounds are used. As a binder, used are polyacrylate resins, polystyrene resins, polyamide resins, acrylic resins, acrylonitrile resins, mathacrylic resins, vinyl chloride resins, vinyl acetate resins, phenol resins, epoxy resins, polyester resins, alkyd resins, polycarbonates, polyurethanes, or copolymer resins containing at least two of any of these resins as repeating units as exemplified by a styrene/butadiene copolymer, a styrene/acrylonitrile copolymer and a styrene/maleic acid copolymer.

The present inventors have revealed that the friction coefficient of a latent-image bearing member increases as temperature rises, depending on temperature characteristics of the binder that occupies most part of the surface of the OPC photosensitive member.

When the friction coefficient of the latent-image bearing member increases as stated above, the friction between the cleaning blade as a cleaning means and the surface of the latent-image bearing member increases. In particular, the friction coefficient abruptly increases when the temperature of the latent-image bearing member becomes higher than 45° C., often causing the vibration of the cleaning blade, a break of the edge of the cleaning blade, or a turnover of the blade which is provided opposite to the direction of movement of the latent-image bearing member, resulting in an extreme lowering of cleaning action.

In order to solve such a problem, the external addition of a lubricant such as a fatty acid metal salt (e.g., zinc stearate) or fine particles of a fluorine compound has been attempted to form a thin layer of the lubricant on the surface of the latent-image bearing member during development so that the friction coefficient on the surface of the latent-image bearing member decreases.

When, however, such a lubricant is externally added to so-called two-component developer, which is a mixture of toner particles and magnetic particles (a carrier), the lubricant may adhere to carrier surfaces (carrier contamination) after long-time use to bring about unstable triboelectric charging of the toner, causing problems such as ground fog, decrease in image density and in-machine contamination due to toner scatter. For a full color image forming apparatus, in particular, the ground fog is transferred in plural times resulting in severe ground fog phenomenon.

As a substitutive means, it has been proposed to provide lubricant coating means in front and the rear of the cleaning means to decrease the friction coefficient of the surface of the latent-image bearing member. This, however, is not preferable since the apparatus becomes large-sized and complicated.

Meanwhile, in recent years, as the image forming apparatus such as electrophotographic color copying machines has become very popular, they are used in various fields and for various purposes and demand for their image quality has become higher and higher. In copying images such as usual photographs, illustrated catalogues and maps, very fine and faithful reproduction without blur is required even at the minute part.

In recent image forming apparatus such as an ectrophotographic color copying machine employing digital image signals, a latent image is formed from dots of a given potential, and solid areas, halftone areas and line areas are expressed by changing the dot density. There, however, is a problem that appropriate tone of a toner image can not be obtained based on the dot density ratio of solid black area and the solid white area of the digital latent image when the toner particles are not accurately laid on the dot area and the toner particles extend beyond the dots. Moreover, when the dot size is made smaller to improve resolution in order to improve image quality, it becomes more difficult to reproduce latent images formed from minute dots, tending to cause unsatisfactory sharpness, a poor resolution and, in particular, a poor gradation at the highlight area.

Sometimes the image quality, though good at the initial stage, deteriorates as copying or printing is continued. This phenomenon is attributed to the toner particles of poor developability accumulated in the developing assembly during copying or printing while the toner particles readily participating in development are preferentially consumed.

For the purpose of improving image quality, some developers have been hitherto proposed. Japanese Laid-Open Patent Application No. 51-3244 discloses a non-magnetic toner whose particle size distribution is controlled to improve the image quality. In this toner, most particles have a diameter of 8 to 12 μm, which is relatively coarse. As a result of studies made by the present inventors, such particle diameters make it difficult for the toner particles to be uniformly and densely "laid" on the latent image. In addition, in view of its feature that particles of 5 μm or smaller in diameter are not more than 30% by number and those of 20 μm or larger in diameter are not more than 5% by number, the broad particle size distribution tends to lower the uniformity. In order to form sharp images using such a toner comprised of rather coarse toner particles with a broad particle size distribution, it is necessary to lay toner particles thick to fill the spaces between toner particles so that apparent image density can be increased. Thus, there is a problem of increased toner consumption to achieve given image density.

Japanese Laid-Open Patent Application No. 54-72054 discloses a non-magnetic toner having a narrower distribution than the foregoing, in which, however, the size of particles with a medium weight is as coarse as 8.5 to 11.0 μm. There is room for further improvement as a high-resolution color toner capable of faithfully develop minute dot latent images.

Japanese Laid-Open Patent Application No. 58-129437 discloses a non-magnetic toner having an average particle diameter of 6 to 10 μm, and 5 to 8 μm for the most particles, in which, however, particles of 5 μm or smaller in diameter are as less as 15% by number. This tends to result in image formation lacking sharpness.

As a result of studies made by the present inventors, it has been discovered that the particles of 5 μm or smaller in diameter participate in clear reproduction of minute dots of the latent image and have a main function for the toner to be densely laid on the whole latent image. In particular, in electrostatic latent images on a photosensitive member, edges that contour an image have a higher electromagnetic intensity than the inner area because of the concentration of lines of electric force at the edge, so that the sharpness in image quality depends on the quality of the toner particles gathering at this part. Studies made by the present inventors have revealed that the amount of the particles of 5 μm or smaller in diameter is important in solving the problem on highlight gradation.

However, the particles of 5 μm or smaller in diameter show particularly strong adhesion to the surface of the latent-image bearing member so that the cleaning becomes difficult.

In addition, continuous printing may cause the fast adhesion of the toner and low electrical resistance materials, e.g., paper dust or ozone addition products, to the photosensitive member. In order to scrape off the matter of a low electrical resistance or the toner having stuck thereto, Japanese Laid-Open Patent Application No. 60-32060 or No. 60-136752 discloses the addition of as an abrasive, that is an inorganic fine powder having a BET surface specific area, as measured by the BET method using nitrogen absorption, of 0.5 to 30 $m^2/g$.

Although this method is effective in preventing the phenomenon of toner sticking, it is unatisfactory to achieve the steady cleaning, when applied to a high-resistance color toner having smaller particle diameter as used in the present invention unless charge stability is improved.

SUMMARY OF THE INVENTION

An object of the present invention is to provide a toner and an image forming method that have solved the problems discussed above.

Another object of the present invention is to provide a toner that can achieve a high image density and superior fine-line reproduction and highlight gradation, and an image forming method making use of such a toner.

Still another object of the present invention is to provide a toner that maintain the cleaning performance even in the long-term use,and an image forming method making use of such a toner.

The present invention provides a toner for developing an electrostatic image, comprising toner particles and external additives, wherein;

said external additives comprise (A) titanium oxide particles having a weight average particle diameter of from 0.01 μm to 0.2 μm, having been subjected to hydrophobic treatment, (B) organic resin particles having a weight average particle diameter of from 0.02 μm to 0.5 μm and (C) an inorganic compound having a weight average particle diameter of from 0.5 μm to 2.5 μm; said external additives being added in an amount satisfying the relationship:

$$(A):(B)=2:1 \text{ to } 10:1$$

$$(A):(C)=1:1 \text{ to } 5:1;$$

and said toner particles have a particle diameter of from 2 μm to 5 μm and are contained in an amount of from 15% by number to 40% by number.

The present invention also provides an image forming method comprising;

(i) forming a developed image on a latent-image bearing member containing an organic photoconductive material, using a toner;

said toner comprising toner particles and external additives, wherein;

said external additives comprise (A) titanium oxide particles having a weight average particle diameter of from 0.01 μm to 0.2 μm, having been subjected to hydrophobic treatment, and (B) organic resin particles having a weight average particle diameter of from 0.02 μm to 0.5 μm; said external additives being added in an amount satisfying the relationship:

$$(A):(B)=2:1 \text{ to } 10:1;$$

and said toner particles have a particle diameter of from 2 μm to 5 μm and are contained in an amount of from 15% by number to 40% by number;

(ii) transferring said developed image to a transfer medium;

(iii) cleaning said latent-image bearing member by means of a cleaning member after image transfer;

said cleaning member comprising a resin substrate and a polyamide resin coat layer provided thereon containing low surface free energy fine particles having a weight average particle diameter of from 0.15 μm to 2.0 μm; and (iv) repeatedly using said latent-image bearing member having been cleaned.

The present invention still also provides an image forming method comprising;

(i) forming a developed image on a latent image bearing member containing an organic photoconductive material, using a toner;

said latent-image bearing member comprising a photosensitive layer containing an organic photoconductive material and a protective layer formed on the outer surface of said photosensitive layer, wherein;

said protective layer contains fluorine-containing resin particles in an amount of from 5% to 40% by weight based on the total weight of the protective layer; and said toner comprising toner particles and external additives, wherein;

said external additives comprise (A) titanium oxide particles having a weight average particle diameter of from 0.01 μm to 0.2 μm, having been subjected to hydrophobic treatment, (B) organic resin particles having a weight average particle diameter of from 0.02 μm to 0.5 μm and (C) an inorganic compound having a weight average particle diameter of from 0.5 μm to 2.5 μm; said external additives being added in an amount satisfying the relationship:

$$(A):(B)=2:1 \text{ to } 10:1$$

$$(A):(C)=1:1 \text{ to } 5:1;$$

and said toner particles have a particle diameter of from 2 μm to 5 μm and are contained in an amount of from 15% to 40% by number;

(ii) transferring said developed image to a transfer medium;

(iii) after the transfer, cleaning said latent-image bearing member by means of a cleaning member; and (iv) repeatedly using said latent-image bearing member having been cleaned.

DESCRIPTION OF THE PREFERRED EMBODIMENTS

Figure 1:
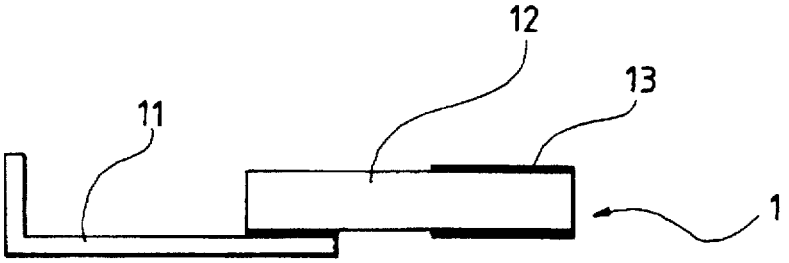
FIG. 1 schematically illustrates a cross section of the cleaning member used in the present invention.

Extensive studies made by the present inventors on the toner for developing electrostatic images of the present invention revealed that in order to obtain good images and steady cleaning performance, a minute gap of 0.1 to 2.5 μm should be present at the part where a photosensitive member and the cleaning blade come into pressure touch, without depending on the surface properties of toners or the surface properties (surface roughness) of photosensitive members.

To provide the above gap between a photosensitive member and the cleaning blade, one controlling means is the surface roughness of the photosensitive member. However, a photosensitive member with a surface roughness more than 2.0 μm may bring about the problem of a lowering of image quality, in particular, a lowering of highlight reproduction and a coarse image. On the other hand, with a photosensitive member with a smaller surface roughness, control of the roughness is difficult and besides, when the gap has become smaller than 0.1 μm, depending on the extent of the surface abrasion, the cleaning blade may excessively strongly come into presure touch to cause faulty cleaning due to turnover of the blade. Thus, a satisfactory cleaning performance can not be achieved only by the means of only controlling the surface roughness of the photosensitive member.

Now, as a result of further studies made by the present inventors, it has been discovered that a toner containing at least an inorganic compound (C) having a weight average particle diameter of from 0.5 to 2.5 μm as external additives is very effective for steady cleaning performance and achieving high image quality under various environmental conditions to provide good images. Here, the inorganic compound (C) serves as a spacer to moderate an excessive pressure touch between the surface of the organic photosensitive member and the cleaning blade, bringing about appropriate frictional properties or steady cleaning performance.

Although the incorporation of the inorganic compound (C) has brought about a much higher improvement of cleaning performance at the initial stage, it was found difficult to maintain the initial cleaning performance without the improvement of the fluidity of toner and the stabilization of the toner charging.

Then, it was discovered that the charging can be made stable and the fluidity can be improved when titanium oxide particles (A) having a weight average particle diameter of from 0.01 μm to 0.2 μm, having been subjected to hydrophobic treatment, organic resin particles (B) having a weight average particle diameter of from 0.02 μm to 0.5 μm and the inorganic compound (C) are added in combination, remarkably improving clearing peroformance.

In relation to the image forming method of the present invention, it has been discovered as a result of extensive studies made by the present inventors that a cleaning system using as the cleaning blade a cleaning blade comprising a urethane resin substrate covered on its surface with a polyamide resin coat layer containing low surface free energy fine particles having a weight average particle diameter of from 0.15 μm to 2.0 μm is very effective for the stable lubricity between the photosensitive member and the cleaning blade.

Although the employment of the above cleaning blade has certainly brought about an improvement in cleaning performance, it was found impossible to achieve a satisfactory cleaning performance when the toner particles having a particle diameter of 2 to 5 μm are contained in an amount of as much as 15 to 40% by number in the present invention. Because in such a case, even though the cleaning performance at the initial stage is good, the latitude of cleaning performance may become narrow during running, particularly in an environment of low humidity, tending to cause faulty cleaning (slip-through of toner).

Now, as a result of further studies made by the present inventors, it has been discovered that a toner containing as external additives at least titanium oxide particles (A) having a weight average particle diameter of from 0.01 μm to 0.2 μm, having been subjected to hydrophobic treatment, and organic resin particles (B) having a weight average particle diameter of from 0.02 μm to 0.5 μm can prevent charge-up of the toner particularly in an environment of low humidity, and hence is very effective in stabilizing cleaning performance and achieving high image quality to provide good images.

In relation to another embodiment of the image forming method of the present invention, the present inventors have found that good images and stable cleaning performance can be obtained while maintaining the running performance of the photosensitive member, when an electrophotographic photosensitive member comprising a conductive support, a photosensitive layer provided thereon and a protective layer is characterized in that the surface of the photosensitive member contains fluorine-containing resin particles and a minute gap of 0.1 to 2.5 μm is present at the part where the photosensitive member comes into pressure touch with a cleaning blade. They have found that, in such an instance, the charging is stabilized and the fluidity is improved by using external additives comprising at least an inorganic compound (C) having a weight average particle diameter of from 0.5 μm to 2.5 μm or titanium oxide particles (A) having a weight average particle diameter of from 0.01 μm to 0.2 μm, having been subjected to hydrophobic treatment, and organic resin particles (B) having a weight average particle diameter of from 0.02 μm to 0.5 μm in combination with the inorganic compound (C).

Here, the stabilization of cleaning performance in another embodiment of the image forming method of the present invention is attributed to the scraping of corona product formed on the surface of the photosensitive member or paper dust stuck thereto.

Components of the present invention will now be described below.

The inorganic compound (C) as an external additive according to the present invention may be any of those having a weight average particle diameter of from 0.5 to 2.5 μm. There are no limitations on its starting materials and preparation methods. If the inorganic compound (C) has a weight average particle diameter smaller than 0.5 μm, the cleaning blade can not follow up the surface of the photosensitive member when the photosensitive member has a large surface roughness, bringing about an increase in the toner slipping through the cleaning blade to cause uneven charging when latent images are formed, tending to cause image deterioration. If it is larger than 2.5 μm, the excess cleaning may be carried out by the cleaning blade, so that it is difficult for the inorganic compound to stay on the edge of the cleaning blade reducing the function as a spacer, resulting in a poor efficiency.

Materials for the inorganic compound (C), usable in the present invention may include inorganic oxides such as fine silica powder, fine alumina powder, fine titanium oxide powder, fine zirconium oxide powder and fine magnesium oxide powder, nitrides such as fine boron nitride powder, fine aluminum nitride powder and fine carbon nitride powder.

More preferable inorganic compound (C) may include calcium titanate, strontium titanate, barium titanate, magnesium titanate, cerium titanate, zirconium oxide, aluminum oxide, titanium oxide, zinc oxide and calcium carbonate.

In the present invention, it is a characteristic feature that the titanium oxide particles (A) having a weight average particle diameter of from 0.01 μm to 0.2 μm, having been subjected to hydrophobic treatment, and the organic resin particles (B) having a weight average particle diameter of from 0.02 μm to 0.5 μm are contained as fluidity improvers.

Incorporation of these titanium oxide particles (A) and organic resin particles (B) brings about an improvement in charge stabilization and fluidity, and is very effective to improve the cleaning performance. This effect cannot be provided by the known fluidity improver, hydrophobic silica.

As the reason therefor, this is due to the fact that fine silica particles are strongly negatively chargeable in themselves and on the other hand fine titanium particles are substantially not chargeable. Japanese Laid-Open Patent Application No. 59-52255 discloses addition of hydrophobic titanium oxide. However, fine titanium oxide particles originally have smaller surface activity than silica and cannot be sufficiently hydrophobidized in a gaseous phase. The hydrophobicity can be increased when the treating agent is used in a large quantity or a treating agent with a high viscosity is used, however, particls may cohere one another to cause a lowering of fluidity-providing ability. Thus, both the charge stabilization and the impartment of fluidity have not necessarily been achieved.

It has been found that when the surface treatment of fine titanium oxide particles that is carried out in an aqueous system by mechanically dispersing them to have primary particle diameter while hyrolyzing a coupling agent particles less cohere one another compared with the treatment in a gaseous phase. It has been also found that charge repulsion between particles as a result of the treatment allows the fine titanium oxide particles to be surface-treated in the state of primary particles.

Thus, in the present invention, the particle surfaces of titanium oxide may preferably be treated while hydrolyzing a coupling agent in an aqueous system. In such an instance, since a mechanical force is applied in order to disperse the fine titanium oxide particles into primary particles, it is unnecessary to use coupling agents that may generate gas as exemplified by chlorosilanes or silazanes, and also it becomes possible to use high-viscosity coupling agents that cannot be used in a gaseous phase because of cohesion between particles, so that the hydrophobicity treatment can be greatly effective.

The coupling agent usable in the present invention may be any of those including silane coupling agents and titanium coupling agents. Silane coupling agents are particularly preferably used, which are represented by the following formula (1), $$R_mSiY_n \quad (1)$$

wherein;

R: an alkoxyl group;

m: an integer of 1 to 3;

Y: a hydrocarbon group containing an alkyl group, a vinyl group, a glycidoxy group or a methacrylic group; and n: an integer of 1 to 3;

including, for example, vinyltrimethoxysilane, vinyltriethoxysilane, γ-methacryloxypropyltrimethoxysilane, vinyltriacethoxysilane, methyltrimethoxysilane, methyltriethoxysilane, isopropyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

In the present invention, particularly preferable silane coupling agents are represented by the following formula (2):

$$C_nH_{2n+1}—Si—(OC_mH_{2m+1})_3 \quad (2)$$

wherein;

n: 4 to 12; and m: 1 to 3.

Here, if n in the formula (2) is smaller than 4, the treatment may become easier, but no sufficient hydrophobicity can be obtained. On the other hand, if n is larger than 12, the hydrophobicity may become sufficient, but titanium oxide particles may more cohere one another, resulting in a lowering of fluidity-providing ability.

The letter symbol m may preferably represents 1 to 3, and more preferably 1 or 2. If m is larger than 3, the reactivity may become lower to give no sufficient hydrophobicity.

The treating agent for the titanium oxide particles (A) having been subjected to hydrophobicity treatment should preferably be used in an amount of from 1 to 50 parts by weight, and more preferably from 3 to 40 parts by weight, based on 100 parts by weight of titanium oxide. The titanium oxide particles (A) should preferably be treated to have a hydrophobicity of from 40 to 80%, and mope preferably from 50 to 80%.

If the hydrophobicity is smaller than 40%, charges may greatly decrease When the toner is left in an environment of high humidity for a long period of time, so that a hard-wear mechanism for charge promotion is required making the apparatus complicated in structure. If the hydrophobicity is more than 80%, it becomes difficult to control charges of titanium oxide itself, tending to result in charge-up of the toner in an environment of low humidity.

The titanium oxide particles (A) used in the present invention should preferably have a weight average particle diameter of from 0.01 to 0.2 μm, and preferably from 0.015 to 0.15 μm, in view of the impartment of fluidity. If the particles have a weight average particle diameter larger than 0.2 μm, the toner may be not uniformly charged because of poor fluidity, resulting in occurrence of toner scatter and fogging.

If the titanium oxide particles (A) have a weight average particle diameter smaller than 0.01 μm, the particles tend to be buried in the surfaces of toner particles, resulting in a lowering of running performance. This tendency is more remarkable in color toners of a sharp-melt type used in the present invention.

In the present invention, there are no particular limitations on the method by which the titanium oxide particles (A) are treated. It is effective to use a method in which a coupling agent is hydrolyzed in an aqueous system while titanium oxide particles are mechanically dispersed to have primary particle diameter. This method is also preferable because no organic solvent is used.

In the present invention, it is also a characteristic feature that the treated titanium oxide particles (A) has a light transmittance of preferably 40% or more, and more preferably 50% or more, at a light wavelength of 400 nm.

That is, when the titanium oxide particles of the present invention having the transmittance to visible light less than 40% are used as an external additive in the full color toner, the projected images of OHP may become dark to give obscured images.

The titanium oxide particles (A) of the present invention are also preferable when the toner particle diameter becomes smaller. When the toner has a smaller particle diameter, the surface area per unit weight increases to tend to cause excessive charging due to rubbing friction. As a countermeasure therefor, the fine titanium oxide particles that can control charging and impart fluidity are greatly effective.

For the organic resin particles (B) used in the present invention preferably, it is suitable to have a polarity reverse to that of colorant-containing resin particles (toner particles) and has a weight average particle diameter of from 0.02 to 0.5 μm, and preferably from 0.04 to 0.4 μm.

The reason therefor is that any charge-up of the toner used in the present invention is moderated by the above organic resin particles (B).

The addition of the organic resin particles (B) also enables acceleration of the rise of charging of the toner, so that a charge performance becomes very stable from the initial stage.

The reason therefor is still unclear. It is presumed as follows: At the initial stage of rubbing friction between a charge-providing member such as carrier and the toner, the organic resin particles (B) are charged in the state they are more strongly attracted to the charge-providing member than to the toner particles. Hence, the rise of charging of the toner particles can be accelerated. On the other hand, once the charging has risen, the organic resin particles (B) are more strongly attracted to the toner particles than to the charge-providing member, so that they function to moderate excessive charging. Thus, the toner constituted according to the present invention can well and stably maintain in various environments the levels of the rise of charging and quantity of saturated triboelectricity.

In order to make the above action more effective, the organic resin particles (B) may preferably have two distribution peaks in particle size distribution in the regions of from 0.02 to 0.2 μm and from 0.3 to 0.8 μm. The peak in 0.3–0.8 μm region should preferably be present in a proportion of not more than 20% by weight to not less than 2% by weight, and more preferably not more than 13% by weight to not less than 3% by weight. If the organic resin particles (B) have a particle diameter smaller than the above range, they may too strongly adhere to the toner particles or may be buried therein, resulting in the loss of the above effect. On the other hand, if they have a particle diameter larger than the above range, they may be non-uniformly dispersed or become released, resulting in the loss of the effect.

In the present invention, in order for the organic resin particles (B) to surely exhibit its properties and have a stable negative chargeability, they may preferably be contained in the toner in an amount of from 0.1 to 5.0% by weight, and more preferably from 0.15 to 3.0% by weight, based on the weight of the toner particles.

The organic resin particles (B) are effective also when the toner is designed to have a smaller particle diameter.

More specifically, when the toner has a smaller particle diameter, the contact points between the toner and the carrier increase, tending to cause carrier-spent, or results in an increase in contact points between toner particles themselves, tending to cause toner blocking. As a countermeasure therefor, the organic resin particles (B) comprising a spherical organic resin particles (B) having an appropriate size of 0.02 to 0.2 μm can serve as a good spacer to bring about a good effect on the above problems. To prevent the toner blocking, it is more effective to use as the organic resin particles (B), reverse-polarity resin particles made of a material having a higher Tg than the toner resin.

As previously discussed, there are some examples of adding resin particles with a reverse polarity. For example, Japanese Laid-Open Patent Application No. 54-45135 and Japanese Patent Publication No. 52-32256 disclose adding colorless resin particles smaller than toner particles.

In these examples, however, as stated therein, the toner and the reverse-polarity resin particles independently behave, where at the time of development the toner adhere to latent image areas and on the other hand the reverse-polarity resin particles adhere to background areas.

In other words, it means that the reverse-polarity resin particles act to promote the charging of toner. In the present invention, however, reverse-polarity resin particles sufficiently smaller in particle diameter than the toner particles are used so that they can finally strongly adhere to the toner and participate in development together with the toner, and relatively coarse resin particles of from 0.3 to 0.8 μm are allowed to appropriately remain in the transfer residue so that cleaning performance can be more improved on account of the co-presence of the inorganic compound (C) previously described or the combination with the cleaning blade previously described. The present invention characterized in this way is different from the invention disclosed in the above publications.

Japanese Patent Publication No. 2-3172 discloses a system used for the purpose of not to lower toner charging. This is different from the present invention in which the system is intentionally used to lower the charging of a non-magnetic color toner that tends to cause excessive charging.

There are no particular limitations on monomers that constitute the organic resin particles (B) used in the present invention, provided that they are selected taking account of the quantity of triboelectricity of the toner. Addition-polymerizable monomers usable in the organic resin particles (B) used in the present invention may specifically include the following monomers.

(i) They include styrene, and derivatives thereof as exemplified by alkyl styrenes such as methyl styrene, dimethyl styrene, trimethyl styrene, ethyl styrene, diethyl styrene, triethyl styrene, propyl styrene, butyl styrene, hexyl styrene, heptyl styrene and octyl styrene, halogenated styrenes such as fluorostyrene, chlorostyrene, bromostyrene, dibromostyrene and iodostyrene, and also nitrostyrene, acetylstyrene and methoxystyrene.

(ii) They also include addition-polymerizable unsaturated carboxylic acids, e.g., addition-polymerizable unsaturated aliphatic monocarboxylic acids such as acrylic acid, mathacrylic acid, α-ethylacrylic acid, crotonic acid, α-methylcrotonic acid, α-ethylcrotonic acid, isocrotonic acid, tiglic acid and ungelic acid, and addition-polymerizable unsaturated aliphatic dicarboxylic acids such as maleic acid, fumaric acid, itaconic acid, citraconic acid, methaconic acid, glutaconic acid and dihydromuconic acid.

(iii) Any of these carboxylic acids formed into metal salts can also be used, and such formation into metal salts can be carried out after completion of polymerization.

(iv) They include compounds obtained by esterification of any of the above addition-polymerizable unsaturated carboxylic acids with an alcohol such as an alkyl alcohol, an alkyl halide alcohol, an alkoxyalkyl alcohol, an aralkyl alcohol or an alkenyl alcohol. Such an alcohol may specifically include alkyl alcohols such as methyl alcohol, ethyl alcohol, propyl alcohol, buryl alcohol, amyl alcohol, hexyl alcohol, heptyl alcohol, octyl alcohol, nonyl alcohol, dodecyl alcohol, tetradecyl alcohol and hexadecyl alcohol; alkyl halide alcohols obtained by halogenating part of any of these alkyl alcohols; alkoxyalkyl alcohols such as methoxyethyl alcohol, ethoxyethyl alcohol, ethoxyethoxyethyl alcohol, methoxypropyl alcohol and ethoxypropyl alcohol; aralkyl alcohols such as benzyl alcohol, phenylethyl alcohol and phenylpropyl alcohol; and alkenyl alcohols such as allyl alcohol and crotonyl alcohol.

(v) They include amides and nitriles derived from any of the above addition-polymerizable unsaturated carboxylic acids; aliphatic monoolefins such as ethylene, propylene, butane and isobutylene; aliphatic orefin halides such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride and vinylidene fluoride; and conjugated aliphatic olefins such as 1,3-butadiene, 1,3-pentadiene, 2-methyl-1,3-butadiene, 2,3-dimethyl-1,3-butadiene, 2,4-hexadiene and 3-methyl-2,4-hexadiene.

(vi) They include vinyl acetates, vinyl ethers, and nitrogen-containing vinyl compounds such as vinylcarbazole, vinylpyridine and vinylpyrrolidone.

Polymers of any one or more kinds of these monomers can be used in the organic resin particles (B) according to the present invention.

The organic resin particles (B) used in the present invention are not limited to only one kind, and plural kinds of resin particles can be used in combination.

The organic resin particles (B) used in the present invention can be prepared by any processes so long as spherical fine particles can be prepared, as exemplified by spray drying, suspension polymerization, emulsion polymerization, soap-free polymerization, seed polymerization and mechanical pulverization. Of these processes, particularly suited is soap-free polymerization that causes no inhibition of charge performance of the toner and less environment-dependent variations of electrical resistivity since the emulsifying agent does not remain after the polymerization. The suited process is by no means limited to this.

In order to make the organic resin particles (B) used in the present invention have two distribution peaks in their particle size distribution, two kinds of particles having different particle diameters may be subjected to dry-process blending or wet-process blending followed by drying. It is more preferable to achieve the two peaked distribution by the cohesion of primary particles to an appropriate degree when the product is dried from the state of an emulsion after polymerization. Heat treatment or disintegration treatment may further be optionally carried out.

The organic resin particles (B) may be optionally subjected to particle surface treatment. As a surface treatment method, the surface treatment may be carried out by a method in which particle surfaces are treated with a metal such as iron, nickel, cobalt, copper, zinc, gold or silver by a surface treating process such as vacuum deposition or plating, a method in which any of the above metals, a metal oxide such as magnetic material or conductive zinc oxide, or the like is fixed by ionic adsorption or external addition, or a method in which a triboelectrically chargeable organic compound such as a pigment or a dye and also a polymer resin, etc. is supported by coating or external addition.

The organic resin particles (B) are required to have a molecular weight distribution wherein a peak molecular weight (a molecular weight at which distribution peak is present) is in the range of from 10,000 to 5,000,000, preferably in the range of from 20,000 to 1,000,000. Resin particles with a peak molecular weight larger than 5,000,000 may damage the fixing performance of the color toner, and those with a peak molecular weight smaller than 10,000 may cause contamination of magnetic particles or bring about a poor blocking resistance.

In the present invention, the titanium oxide particles (A), the organic resin particles (B) and the inorganic compound (C) must be added in an amount satisfying the relationship:

$$(A):(B)=2:1 \text{ to } 10:1$$

$$(A):(C)=1:1 \text{ to } 5:1$$

and preferably in an amount satisfying the relationship:

$$(A):(B)=2:1 \text{ to } 10:1$$

$$(A):(C)=2:1 \text{ to } 5:1$$

and more preferably in an amount satisfying the relationship:

$$(A):(B)=3:1 \text{ to } 10:1$$

$$(A):(C)=2:1 \text{ to } 5:1$$

In the present invention, in the case when, as will be described later, the cleaning blade comprising a resin substrate covered thereon with a polyamide coat layer containing low surface free energy fine particles is used, the lubricity between the cleaning blade and the latent-image bearing member can be very stable and hence the inorganic compound (C) described above, though preferably be used, may not necessarily be required.

In this case, the titanium oxide particles (A) and the organic resin particles (B) must be added in an amount satisfying the relationship:

$$(A):(B)=2:1 \text{ to } 10:1$$

and may preferably in an amount satisfying the relationship:

$$(A):(B)=3:1 \text{ to } 10:1$$

When the external additives has a ration outside the above range, it is not preferable since the additives may become not uniform or the cleaning performance and fluidity may be damaged.

In the toner particles according to the present invention, a charge control agent may be mixed so that their charge performance can be stabilized. In that instance, it is preferred to use a colorless or pale-colored charge control agent that does not affect the color tone of the toner. A negative charge control agent usable for such purpose may include organic metal complexes as exemplified by a metal complex of an alkyl-substituted salicylic acid, e.g., a chromium complex or zinc complex of di-tert-butylsalicylic acid. When the negative charge control agent is mixed in the toner particles, it should be added in an amount of from 0.1 to 10 parts by weight, and preferably from 0.5 to 8 parts by weight, based on 100 parts by weight of the binder resin.

When the toner of the present invention and magnetic particles (a carrier) are blended to prepare a two-component developer, they may be blended in such a proportion that the toner is from 2 to 10% by weight, and preferably from 3 to 9% by weight, in the developer. A toner concentration less than 2% by weight tends to cause a decrease in image density, making the developer unsuitable for practical use, and a toner concentration more than 12% by weight tends to cause an increase in fogging or in-machine toner scatter to shorten the service life of the developer.

As a binder material used in the toner particles of the present invention, various material resins can be used, which are conventionally known as 10 toner binder resins for electrophotography. For example, it may include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, polyester resins, and maleic acid resins. Regarding all the resins, there are no particular limitations on their preparation.

Of these resins, the present invention can be greatly effective particularly when polyester resins are used. The polyester resins can achieve excellent fixing performance, and are suited for color developers.

The following polyester resin is more preferred because of its sharp melt properties, which is a polyester resin obtained by condensation polymerization of i) a diol component comprised of a bisphenol derivative or substituted bisphenol represented by the formula:

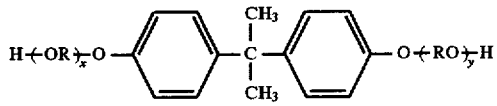

wherein R represents an ethylene group or a propylene group, and x and y each represent an integer of 1 or more, where x+y is 2 to 10 on the average and ii) a carboxylic acid component comprising a dibasic or more basic carboxylic acid, its acid anhydride or its lower alkyl ester, as exemplified by fumaric acid, maleic acid, maleic anhydride, phthalic acid, terephthalic acid, trimellitic acid and pyromellitic acid.

As the colorant usable in the toner particles used in the present invention, it is possible to widely use any known dyes and pigments as exemplified by Phthalocyanine Blue, Indanthrene Blue, Peacock Blue, Permanent Red, Lake Red, Rhodamin Lake, Hanza Yellow, Permanent Yellow and Benzidine Yellow. It may preferably be contained in an amount of not more than 12 parts by weight, and more preferably from 0.5 to 9 parts by weight, in order to ensure a sensitive reflection with respect to light transmission properties of OHP films.

In the present invention, it is still also a characteristic feature that, in particle size distribution of the toner, toner particles with a particle diameter of 2 to 5 μm are contained in an amount of from 15 to 40% by number, and preferably from 20 to 35% by number, in order to faithfully achieve fine-line reproduction and highlight reproduction.

If the toner particles with a particle diameter of 2 to 5 μm are less than 15% by number, faithfulness to originals may be damaged. If they are mode than 40% by number, fogging and toner scatter may increase, and also the toned may slip thorough the cleaning blade even when used in combination with the toned external additives of the present invention, resulting in a lowering of cleaning performance.

When the toned of the present invention is used as a two-component developer, magnetic particles (a carrier) may include magnetic metals as exemplified by surface-treated or untreated iron, nickel, copper, zinc, cobalt, manganese, chromium or rare earth elements, and alloys or oxides of any of these, or ferrite. There are no particular limitations on their preparation.

In the present invention, the surface of the magnetic particles may be coated with resin. The surfaces of magnetic particles can be coated with resin by using any conventional methods including a method in which a coating material such as resin is dissolved or suspended in a solvent is applied to the magnetic particles, and a method in which they are merely mixed in a powdery state. In order to make coat layers stable, the method in which a coating material is dissolved in a solvent is preferred.

The material with which the surfaces of the magnetic particles are coated may vary depending on the materials for the toner. For example, aminoacrylate resins, acrylic resins, or copolymers of such resins with styrene resins are preferable. As negatively chargeable resins, silicone resins, polyester resins, polytetrafluoroethylene, monochlorotrifluoroethylene polymer, polyvinylidene fluoride, etc. are preferable since they are listed on the negative side of the triboelectric series. Examples are not necessarily limited to these. Preferable in the present invention are acrylic resins or copolymers of such resins with styrene resins.

The magnetic particles used in the present invention may most suitably be made of ferrite particles composed of 98% or more of Cu—Zn—Fe [compositional ratio: (5 to 20):(5 to 20):(30 to 80)], for which smooth surface is readily bestowed, and which have stable charge-providing ability and also can make coatings stable.

The above compound may be applied to the magnetic particles in an amount appropriately determined so that the charge-providing ability of the magnetic particles can satisfy the above conditions, and usually in an amount of from 0.1 to 30% by weight in total, and preferably from 0.3 to 20% by weight, based on the weight of the magnetic particles. These magnetic particles may preferably have a weight average particle diameter of from 35 to 65 μm, and preferably from 40 to 60 μm. Good images can be maintained when 2 to 6% of the particles have weight average particle diameter of 26 μm or less, 5 to 25% of them have a weight average particle diameter of from 35 to 43 μm, and 2% or less of them have a weight average particle diameter of 74 μm or more.

The toner particles according to the present invention can be produced in the following way: A thermoplastic resin, and optionally a pigment or dye as a coloring agent, a charge control agent and other additives, are thoroughly mixed using a mixing machine such as a ball mill, and then the mixture is melt-kneaded using a heat kneading machine such as a heating roll, a kneader or an extruder to make the materials compatible, in which a pigment or dye is then dispersed or dissolved, followed by cooling to solidify and thereafter pulverization and strict classification.

FIG. 1 shows the cleaning blade used in the image forming method of the present invention, surface of the blade 12 is substrate covered with a polyamide resin coat layer containing low surface free energy fine particles.

In the image forming method of the present invention, the low surface free energy fine particles of the present invention having a weight average particle diameter of from 0.15 μm to 2.0 μm, and preferably from 0.25 to 1.5 μm, are incorporated into a polyamide resin coat layer 13 which covers the blade substrate 11 of a cleaning blade 1 fixed to a blade support 12. The above fine particles may include fluorine-containing compounds and silicon-containing compounds.

If the low surface free energy fine particles have a particle diameter smaller than 0.15 μm, it becomes difficult for these low surface free energy fine particles to appear at the surface of the coat layer, making the effect of their addition insufficient. If they have a particle diameter larger than 2.0 μm, the uniform dispersion of these particles dispersed in the polyamide resin coat layer becomes difficult, often resulting in the release from the coat layer, and thus shorten the effective period of the addition.

The fluorine-containing compounds may include carbon fluoride and fluorine resin powders including polytetrafluoroethylene, poly/vinylidene fluoride and a tetrafluoethylene/vinylidene fluoride copolymer.

The silicon-containing compounds may include fine silica powder, fine silica-alumina eutectic powder and silicone resin particles. Of these, particularly preferred are silicone resin particles with a siloxane structure having one alkyl group bonded to the silicon atom, which are preferable since they can readily provide a sharp particle size distribution.

Figure 2:
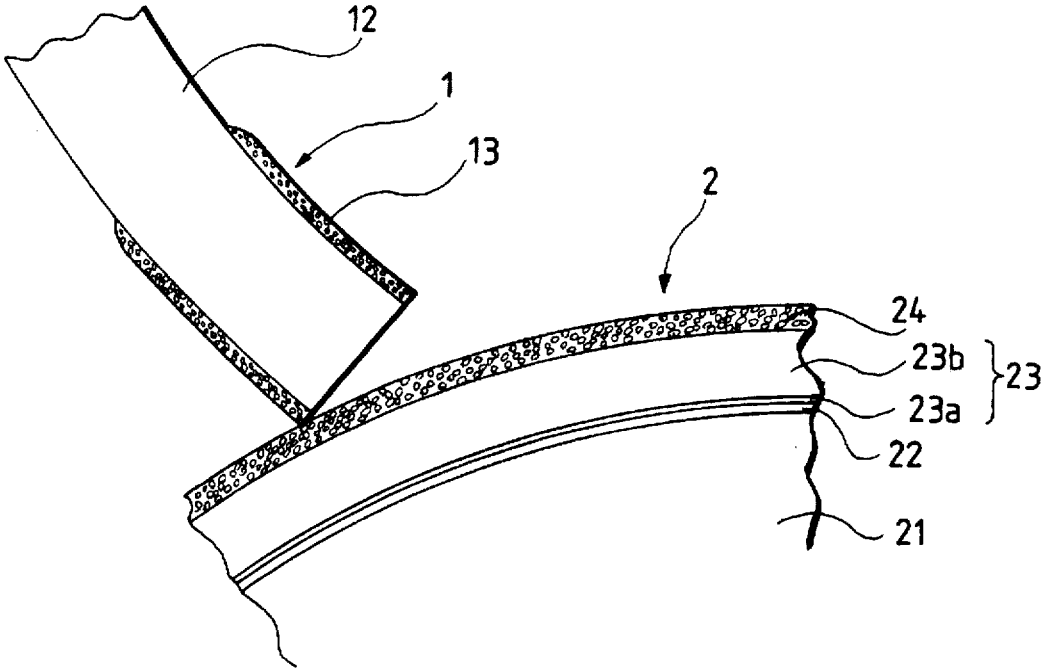
FIG. 2 diagrammatically schematically illustrates the manner of cleaning in which a cleaning member comes into touch with the surface of a latent-image bearing member in the image forming method of the present invention.

FIG. 2 illustrates the latent-image bearing member used in the image forming method of the present invention.

In another embodiment of the image forming method of the present invention, a latent-image bearing member 2 comprises a conductive support 21 and provided thereon a photosensitive layer 23 and a protective layer 24. At least the protective layer 24 contains fluorine-containing resin particles so that the frictional resistance at the surface of the latent-image bearing member 2 can be decreased. The protective layer 24 is also mechanically abraded. The protective layer 24 should preferably have an average surface roughness of 0.1 μm or more to 2.5 μm or less, and more preferably 0.1 μm or more to 1.5 μm or less, indicated by 10-point average surface roughness Rz as prescribed in JIS B061 (hereinafter abridged "average surface roughness").

If the protective layer of the latent-image bearing member has an average surface roughness larger than 2.5 μm, gaps is formed between the surface of the latent-image bearing member 2 and the cleaning blade 1, so that finer particles of the toner particles remained after transfer may slip through the gaps to cause faulty cleaning.

When this average surface roughness is 1.5 μm or less, the friction between the cleaning blade 1 and the surface of the latent-image bearing member 2 can be sufficiently small and so that no faulty images occur even after repeated use, and highlight reproduction is very good.

If this average surface roughness is smaller than 0.1 μm, the friction between the cleaning blade 1 and the surface of the latent-image bearing member 2 can be hardly moderated, and the presence of the fluorine-containing fine resin particles on the surface is not effective for decreasing the friction. Thus, faulty cleaning caused by turnover of the cleaning blade, break of the blade edge, etc. can be prevented when the surface of the latent-image bearing member is coated with a protective layer containing the fluorine-containing fine resin particles, and controlled to have an average surface roughness of 0.1 μm or more to 2.5 μm or less.

The fluorine-containing fine resin particles that can effectively decrease the friction coefficient at the surface of the latent-image bearing member may be in a content of from 5 to 40% by weight, and preferably from 10 to 40% by weight, in the protective layer, based on the total weight of the protective layer. The protective layer may preferably have a layer thickness in the range of from 0.05 μm to 8.0 μm, and more preferably in the range of from 0.5 μm to 6.0 μm.

In the present invention, when the fluorine-containing fine resin particles are also contained in the photosensitive layer 23, the content of such fine particles is limited since the photosensitive layer 23 has a larger thickness than the thin-layer protective layer 24. Stated specifically, their content in the photosensitive layer 23 may preferably be not more than 10% by weight, and more preferably not more than 7% by weight, based on the total weight of the photosensitive layer.

Even though the content of the fluorine-containing fine resin particles in the photosensitive layer 23 is limited, severe lowering of the sensitivity and the image uniformity may occur because of scattering of light when the photosensitive layer 23 is thick in total thickness, in particular, when photocarriers are mainly generated on the support side of the photosensitive layer 23. On the other hand, an excessively thin photosensitive layer may also cause a decrease in sensitivity or a lowering of chargeability because of an increase in capacitance of the photosensitive layer 23. Besides, the photosensitive layer can not be made so extremely thick even when such fine particles are not contained in the photosensitive layer 23. The reason therefor is that the protective layer 24 containing such fine particles is laminated onto the photosensitive layer 23 and the protective layer 24 serves as a light-scattering layer, so that, especially when photocarriers are mainly generated on the support side of the photosensitive layer 23, the light path of the scattered light becomes longer as the photocarrier generating portion is far from the light-scattering layer, i.e., as the photosensitive layer 23 has a larger thickness, the influence of the scattered light becomes strong.

Accordingly, the photosensitive layer may preferably have a thickness of from 10 to 35 μm, and more preferably from 15 to 30 μm, in total, including the thickness of the protective layer. The fluorine-containing fine resin particles contained in the photosensitive layer 23 should preferably be in an amount as small as possible. Thus, such fine particles in the layer with a thickness corresponding to the total of the photosensitive layer 23 and protective layer 24 should be in an average content of not more than 17.5% by weight based on the total weight of the photosensitive layer and protective layer.

The fluorine-containing fine resin particles used in the latent-image bearing member of the present invention are comprised of one or more materials selected from polytetrafluoroethylene, polychlorotrifluoroethlene, polyvinylidene fluoride, polydichlorodifluoroethylene, a tetrafluorothylene/perfluoroalkyl vinyl ether copolymer, a tetrafluoroethylene/hexafluoropropylene copolymer, a tetrafluoroethylene/ethylene copolymer and a tetrafluoroethylene/hexafluoropropylene/perfluoroalkyl vinyl ether copolymer. Commercially available fluorine-containing fine resin particles can be used as they are. Those having a molecular weight of from 3,000 to 5,000,000 can be used, and those having a particle diameter of from 0.01 to 10 μm and preferably from 0.05 to 2.0 μm, can be used.

The photosensitive layer 23 of the latent-image bearing member of the present invention contains at least a charge-generating material and a charge-transporting material as organic photoconductive materials. The charge-generating material may include, for example, phthalocyanine pigments, polycyclic quinone pigments, trisazo pigments, disazo pigments, azo pigments, perylene pigments, indigo pigments, quinacridone pigments, azulenium salt dyes, squarium dyes, cyanine dyes, pyrylium dyes, thiopyrylium dyes, xanthene coloring matter, quinoneimine coloring matter, triphenylmethane coloring matter, styryl coloring matter, selenium, a selenium-tellurium alloy, amorphous silicon and cadmium sulfide.

The charge-transporting material may include, for example, pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, stilbene compounds, polynitro compounds, polycyano compounds, and also pendant polymers comprising any of these compounds fixed on polymers.

In many instances, the above fluorine-containing fine resin particles, charge-generating material, charge-transporting material and so forth are respective dispersed and incorporated into binder resins having film forming properties to form the protective layer and the photosensitive layer. Such binder resins may include polyesters, polyurethanes, polyacrylates, polyethylene, polystyrene, polybutadiene, polycarbonates, polyamides, polypropylene, polyimides, phenol resins, acrylic resins, silicone resins, epoxy resins, urea resins, allyl resins, alkyd resins, polyamide-imide, nylons, polysulfone, polyallyl ethers, polyacetals and butyral resins.

The layer structure of the latent-image bearing member of the present invention will be described below. The conductive support 21 may be made of a metal such as iron, copper, gold, silver, aluminum, zinc, titanium, lead, nickel, tin, antimony or indium or an alloy thereof, an oxide of any of these metals, carbon, or a conductive polymer. It may have the shape of a drum such as a cylinder or a column, a belt, or a sheet. The above conductive materials may be molded as they are, may be used in the form of coating materials, may be vacuum-deposited, or may be processed by etching or plasma treatment. In the case of coating materials, not only the above metal and alloy but also paper and plastic are used as the support.

The photosensitive layer 23 in the latent-image bearing member of the present invention may be 10 of either single-layer structure or laminated structure. In the case of the laminated structure, the layer is comprised of at least a charge generation layer **23*a* and a charge transport layer 23*b*. The charge polarity of the photosensitive layer and therefore, the polarity of toner to be used change when the charge generation layer 23*a* is provided on the side of the conductive support 21 and when the charge transport layer 23*b* is provided on that side. The charge generation layer 23*a* may preferably have a layer thickness of from 0.001 to 6 μm, and more preferably from 0.01 to 2 μm. The charge-generating material contained in the charge generation layer 23*a* may preferably be in a content of from 10 to 100% by weight, and more preferably from 50 to 100% by weight, based on the total weight of the charge generation layer. The charge transport layer 23*b* has a thickness obtained by subtracting the layer thickness of the charge generation layer 23*a* from the photosensitive layer 23. The charge-transporting material contained in the charge transport layer 23*b* may preferably be in a content of from 20 to 80% by weight, and more preferably from 30 to 70% by weight, based on the total weight of the charge transport layer 23*b***.

A subbing layer may be provided between the conductive support 21 and the photosensitive layer 23. The subbing layer 22 controls charge injection at the interface or functions as an adhesive layer. The subbing layer 22 is mainly composed of a binder resin. It may also contain the above metal or alloy described above, an oxide or salt thereof, a surface active agent, etc. As the binder resin to form the subbing layer 22, those enumerated as the binder resins of the photosensitive layer 23 can be used. The subbing layer may preferably have a layer thickness of from 0.05 to 7 μm, and more preferably from 0.1 to 2 μm.

The protective layer is always provided on the photosensitive layer as previously described, and is comprised of at least the binder resin and the fine resin particles containing fluorine atoms in a high concentration.

The latent-image bearing member used in the present invention can be produced by vacuum deposition or coating. When produced by coating, films can be formed in a wide range of from thin films to thick films and also in a variety of composition. Stated specifically, the coating is carried out using a coating process such as bar coating, knife coating, dip coating, spray coating, beam coating, electrostatic coating, roll coating, artitor coating and powder coating.

The coating material used to form the protective layer can be obtained by dispersing the fluorine-containing fine resin particles in the binder resin and a solvent. The dispersion is carried out by means of a ball mill, an ultrasonic, a paint shaker, a red devil or a sand mill. The same dispersion method can be used also in the cases of conductive fine powder, pigment, and charge-generating materials comprising a pigment.

Measuring methods used in the present invention will be described below.

(1) Measurement of toner particle size distribution:

The particle size distribution can be measured by various methods. In the present invention, it is measured using a Coulter counter.

A Coulter counter Type TA-II (manufactured by Coulter Electronics, Inc. is used as a measuring device. An interface (manufactured by Nikkaki k.k.) that outputs number distribution and volume distribution and a personal computer CX-1(manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Particle size distribution of particles of 2 μm to 40 μm are measured on the basis of the number by means of the above Coulter counter Type TA-II, using an aperture of 100 μm as its aperture. Then the values according to the present invention are determined.

(2) Measurement of particle size of external additives:

Apparatus

Coulter counter Type N4 is used as a measuring apparatus, and UD-200, manufactured by K.K. Tomy Seiko, as a dispersion ultrasonic oscillator.

Procedure

A sample of an appropriate amount is put into 30 to 50 ml of distilled water to which a surface active agent has been added in a trace amount, followed by dispersion using the above ultrasonic oscillator at an output of 2 to 6 for 2 to 5 minutes. The sample suspension is transferred to a cell, which is left to stand until air bubbles disappear, and then set on the above Coulter counter previously set at a measuring temperature of 50° C. After the sample was left for 10 to 20 minutes to have a constant temperature, the measurement is started to determine volume average particle size distribution.

(3) Measurement of hydrophobicity:

Methanol titration is an experimental means for ascertaining the hydrophobicity of fine titanium oxide powder whose surfaces have been made hydrophobic.

In order to evaluate the hydrophobicity of the treated fine titanium oxide powder, the "methanol titration" as defined in the present specification is carried out in the following way: 0.2 g of fine titanium oxide powder to be tested is added to 50 ml of water contained in a 250 ml Erlenmeyer flask. Methanol is dropwise added from a buret until the whole of the fine titanium oxide powder has been wetted. Here, the solution inside the flask is continually stirred using a magnetic stirrer. The end point is when the whole fine titanium oxide powder are suspended. The hydrophobicity is expressed as a percentage of the methanol present in the liquid mixture of methanol and water when the reaction has reached the end point.

(4) Measurement of transmittance:

| | |
|---|---|
| 1. Sample | 0.10 g |
| Alkyd resin | 13.20 g *1 |
| Melamine resin | 3.30 g *2 |
| Thinner | 3.50 g *3 |
| Glass media | 50.00 g |

*1 BECKOZOLE 1323-60-EL, available from Dainippon Ink & Chemicals, Incorporated

*2 SUPER BECKAMINE J-820-60, available from Dainippon Ink & Chemicals, Incorporated

*3 AMILUCK THINNER, available from Kansai Paint Co., Ltd.

Materials with the above composition are collected in a 150 cc jar, and dispersion is carried out for 1 hour using a paint conditioner manufactured by Red Devil Co.

2. After the dispersion has been completed, the dispersed product is applied on a PET film by means of a 2 mil. doctor blade.
3. The coating formed in 2. is heated at 120° C. for 10 minutes to carry out baking.
4. The sheet obtained in 3. is set on U-BEST, manufacture by Nihon Bunkou Co., to measure its transmittance in the range of 320 to 800 nm and make comparison.

As described above, the toner or image forming method according to the present invention can improve the durability (running performance) of the latent-image bearing member, prevent faulty cleaning and faulty images, and obtain images having superior fine-line reproduction and highlight gradation.

EXAMPLES

The present invention will be described below in greater detail by giving Examples. These by no means limit the present invention. In the following formulation, "part(s)" and "%" refer to "part(s) by weight" and "% by weight", respectively, unless particularly noted.

Synthesis Example 1

While mixing and stirring hydrophobic fine titanium oxide particles produced in an aqueous system, $nC_4H_9$—Si $(OCH_3)_3$ was added in an amount of 30% by weight based on the weight of the fine titanium oxide particles and mixed so that the particles do not to cohere, followed by drying and disintegration to give fine titanium oxide particles I having a hydrophobicity of 70%, an average particle diameter of 0.05 μm and a transmittance of 55% at 400 nm.

Synthesis Example 2

Synthesis Example 1 was repeated except that $nC_8H_{17}$—$Si(OCH_3)_3$ was used in an amount of 20% by weight, to give fine titanium oxide particles II having a hydrophobicity of 60%, an average particle diameter of 0.05 μm and a transmittance of 50% at 400 nm.

Example 1

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 2 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified using a multi-division classifier, selecting 2 to 10 μm particles so as to attain the particle size distribution of the present invention. Thus, colorant-containing resin particles (toner particles) were obtained.

To the above colorant-containing resin particles, 1.0% of fine titanium oxide particles I of Synthesis Example 1, 0.4% of cerium oxide with a weight average particle diameter of 1.9 μm and 0.3% of organic resin particles 1 with a weight average particle diameter of 0.065 μm and having two distribution peaks at 0.05 μm and 0.8 μm (quantity of triboelectricity: +55 μc/g) were compounded to give a cyan toner.

In this toner, (A):(B) was 3.33:1 and (A):(C) was 2.5:1.

This toner had a weight average particle diameter of 8.4 μm (toner particles of 5 μm or less in diameter was 30% by number).

To such a toner, Cu—Zn—Fe ferrite particles whose surfaces had been coated with a styrene/butyl methacrylate copolymer were added to prepare developer 1 with a toner concentration of 5%.

Images were reproduced using this developer 1 and a commercially available color copying machine (CLC500, manufactured by Canon Inc.) employing i) a photosensitive member (latent-image bearing member) having a photosensitive layer on the surface of which no protective layer was formed and ii) a cleaning member made of urethane resin whose surface is not covered with the coat layer.

Development was carried out under conditions of a development contrast of 320 V in environments of temperature/humidity 20° C./10% RH, 23° C./65% RH and 30° C./80% RH each, using an original of 50% in image area percentage. Images were reproduced on 20,000 sheets for each environment.

As a result, no faulty cleaning occurred at all and image density was very stable at 1.4 to 1.6 and coarseness-free, very sharp images were obtained. The drum surface was also examined to find that no deposit was seen.

Example 2

Developer 2 was prepared in the same manner as in Example 1 except that the cerium oxide used therein was replaced with 0.3% of strontium titanate with a weight average particle diameter of 1.3 μm. Images were reproduced in the same way. As a result, good results were obtained.

In the toner of this developer, (A):(B) was 3.33:1 and (A):(C) was 3.33:1.

Example 3

Developer 3 was prepared in the same manner as in Example 1 except that the organic resin particles 1 used therein were replaced with 0.5% of organic resin particles 2 having a distribution peak at particle diameter of 0.15 μm and the weight average particle diameter of 0.15 μm. Images were reproduced in the same way. As a result, good results were obtained.

In the toner of this developer, (A):(B) was 2:1 and (A):(C) was 2.5:1.

Example 4

Developer 4 was prepared in the same manner as in Example 1 except that the fine titanium oxide particles I used therein were replaced with 1.0% of fine titanium oxide particles II. Images were reproduced in the same way. As a result, good results were obtained.

In the toner of this developer, (A):(B) was 3.33:1 and (A):(C) was 2.5:1.

Comparative Example 1

Comparative developer 1 was prepared in the same manner as in Example 1 except that the cerium oxide was not used. Images were reproduced in the same way. As a result, in the environment of temperature/humidity 20° C./10% RH, faulty images with blank areas (filming) appeared at solid blue areas in which toner consumption was large on about the 10,000th and the following sheets.. Then, the drum surface was examined to find that deposits were seen on the drum.

In the toner of this developer, (A):(B) was 3.33:1 and (A):(C) was 1:0.

Comparative Example 2

Comparative Example 1 was repeated except that an original of 20% in image area percentage was used so that the toner consumption was decreased. As a result, in the environment of temperature/humidity 20° C./10% RH, no filming on the part of image area was seen on 20,000 sheets. Then, the drum surface was examined to find that deposits, though only a little, were seen on the drum.

Comparative Example 3

Comparative developer 2 was prepared in the same manner as in Example 1 except that the organic resin particles 1 were not used. Images were reproduced in the same way. As a result, in the environment of temperature/humidity 20° C./10% RH, toner scatter occurred on about the 5,000th and the following sheets. This was considered due to the delay in the rise of charging of the supplied toner, due to the absence of the organic resin particles 1.

In the toner of this developer, (A):(B) was 1:0 and (A):(C) was 2.5:1.

Comparative Example 4

Comparative developer 3 was prepared in the same manner as in Example 1 except that the fine titanium oxide particles I were not used. Images were reproduced in the same way. As a result, in the environment of temperature/humidity 23° C./65% RH, image density was as low as 1.21, and only coarse images were obtainable.

In the toner of this developer, (A):(B) was 0:0.3 and (A):(C) was 0:0.4.

Comparative Example 5

Comparative developer 4 was prepared in the same manner as in Example 1 except that the cerium oxide used therein was replaced with 0.4% of cerium oxide with a weight average particle diameter of 0.3 μm. images were reproduced in the same way. As a result, in the environment of temperature/humidity 23° C./65% RH, uneven images were obtained at halftone areas. Then, the drum surface was examined to find that cerium oxide having slipped through the cleaning blade was seen thereon.

In the toner of this developer, (A):(B) was 3.33:1 and (A):(C) was 2.5:1.

Comparative Example 6

Comparative developer 5 was prepared in the same manner as in Example 1 except that the cerium oxide used therein was replaced with 0.4% of cerium oxide with a weight average particle diameter of 3 μm. Images were reproduced in the same way. As a result, the cleaning blade edge was scratched to cause faulty cleaning.

In the toner of this developer, (A):(B) was 3.33:1 and (A):(C) was 2.5:1.

Comparative Example 7

Comparative developer 6 was prepared in the same manner as in Example 1 except that the cerium oxide used therein was used in an amount of 1.2%. Images were reproduced in the same way. As a result, in the environment of temperature/humidity 20° C./10% RH, toner scatter occurred on about the 3,000th and the following sheets.

In the toner of this developer, (A):(B) was 3.33:1 and (A):(C) was 0.83:1.

Example 5

To the same colorant-containing resin particles (toner particles) as in Example 1, 1.0% of fine titanium oxide particles I of Synthesis Example 1 and 0.3% of organic resin particles 1 with a weight average particle diameter of 0.065 μm and having two distribution peaks at 0.05 μm and 0.8 μm (quantity of triboelectricity: +55 μc/g) were compounded to give a cyan toner.

In this toner, (A):(B) was 3.33:1.

This toner had a weight average particle diameter of 8.4 μm (toner particles of 5 μm or less in diameter is 30% by number).

To such a toner, Cn—Zn—Fe ferrite particles whose surfaces had been coated with a methyl methacrylate/buryl methacrylate copolymer (70:30) were added to prepare developer 5 with a toner concentration of 5%.

Images were reproduced using this developer 5 and a commercially available color copying machine (CLC500, manufactured by Canon Inc.) whose cleaning blade was modified to the cleaning blade as shown in FIGS. 1 and 2 having a urethane blade substrate 12 whose surface had been covered with a polyamide resin coat layer 13 comprising polyamide resin containing 10 parts of fine silicone resin particles with a weight average particle diameter of 1.0 μm.

Development was carried out under conditions of a development contrast of 320 V in environments of temperature/humidity 20° C./10% RH, 23° C./65% RH and 30° C./80% RH each, using an original having 50% image area. Images were reproduced on 20,000 sheets for each environment.

As a result, no faulty cleaning occurred at all and image density was very stable at 1.4 to 1.6 and coarseness-free, very sharp images were obtained. The drum surface was also examined and no deposit was seen.

Example 6

The cleaning blade was modified in the same manner as in Example 5 except that the fine silicone resin particles used therein was replaced with 10 parts of fine carbon fluoride powder with a weight average particle diameter of 0.8 μm. Using the developer 5, images were reproduced in the same way. As a result, good results were obtained.

Example 7

Developer 6 was prepared in the same manner as in Example 5 except that the organic resin particles 1 used therein was replaced with 0.3% of organic resin particles 2 having a peak at a weight average particle diameter of 0.15 μm. Images were reproduced in the same way. As a result, although image density slightly decreased to 1.35 to 1.45 in the environment of temperature/humidity 20° C./10% RH, compared with that in Example 5, good results were obtained.

In the toner of this developer, (A):(B) was 3.33:1.

Example 8

Developer 7 was prepared in the same manner as in Example 5 except that the fine titanium oxide particles I used therein was replaced with 1.0% of fine titanium oxide particles II. Images were reproduced in the same way. As a result, good resultS were obtained.

In the toner of this developer, (A):(B) was 3.33:1.

Comparative Example 8

Example 5 was repeated except that the cleaning blade used therein was replaced with a cleaning blade whose surface was not covered with the polyamide resin coat layer. Using the developer 5, images were reproduced in the same way. As a result, in the environment of temperature/humidity 20° C./10% RH, faulty images with blank areas (filming) appeared at solid blue areas in which toner consumption was large, on about the 10,000th and the following sheets. Then, the drum surface was examined and deposits were seen thereon.

Comparative Example 9

Comparative Example 8 was repeated except that an original of 20% in image area percentage was used so that the toner consumption was decreased. As a result, in the environment of temperature/humidity 20° C./10% RH, no filming on the part of images was seen on 20,000 sheets. Then, the drum surface was examined to find that deposits, though only a little, were seen on the drum.

Comparative Example 10

Comparative developer 7 was prepared in the same manner as in Example 5 except that the organic resin particles 1 used therein were not used. Images were reproduced in the same way. As a result, in the environment of temperature/humidity 20° C./10% RH, toner scatter occurred on about the 5,000th and the following sheets. This was considered due to the delay in the rise of charging of the supplied toner, due to the absence of the organic resin particles 1.

In the toner of this developer, (A):(B) was 1:0.

Comparative Example 11

Comparative developer 8 was prepared in the same manner as in Example 1 except that the fine titanium oxide particles I was not used. Images were reproduced in the same way. As a result, in the environment of temperature/humidity 23° C./65% RH, image density was as low as 1.21, and only very coarse images were obtained.

In the toner of this developer, (A):(B) was 0:0.3.

Comparative Example 12

Example 5 was repeated except that the cleaning blade used therein was replaced with a cleaning blade whose surface had been covered with a polyamide resin coat layer containing no fine silicone resin particles. Using the developer 5, images were reproduced in the same way. As a result, in the environment of temperature/humidity 30° C./80% RH, the pressure touch between the photosensitive member and the cleaning blade became so strong that uneven images were obtained.

Comparative Example 13

Example 5 was repeated except that the cleaning blade used therein was replaced with a cleaning blade whose surface was covered with a polyamide resin coat layer containing fine silicone resin particles with a weight average particle diameter of 0.10 μm. Using the developer 5, images were reproduced in the same way. As a result, in the environment of temperature/humidity 30° C./80% RH, although good results were obtained in the initial stage, a strange sound, presumably a rubbing frictional sound produced between the photosensitive member and the cleaning blade, was heard on about 2,000th and the following sheets. Then, the edge of the cleaning blade was examined to find that a number of faults considered due to falling-off of the fine silicone resin particles were seen.

Latent Image Bearing Member Production

Example 1

10 parts of nylon (M-4000, available from Toray Industries, Inc.), 100 parts of methanol and 90 parts of isopropanol were mixed and dissolved. Thereafter, the resulting solution was applied by dip-coating on a cylinder 21 made of aluminum, with an outer diameter of 80 mm, a wall thickness of 1.5 mm and a length of 363 mm, followed by drying at 90° C. for 20 minutes to form a 2.0 μm thick subbing layer 22.

Next, 10 parts of triazo pigment represented by the structural formula:

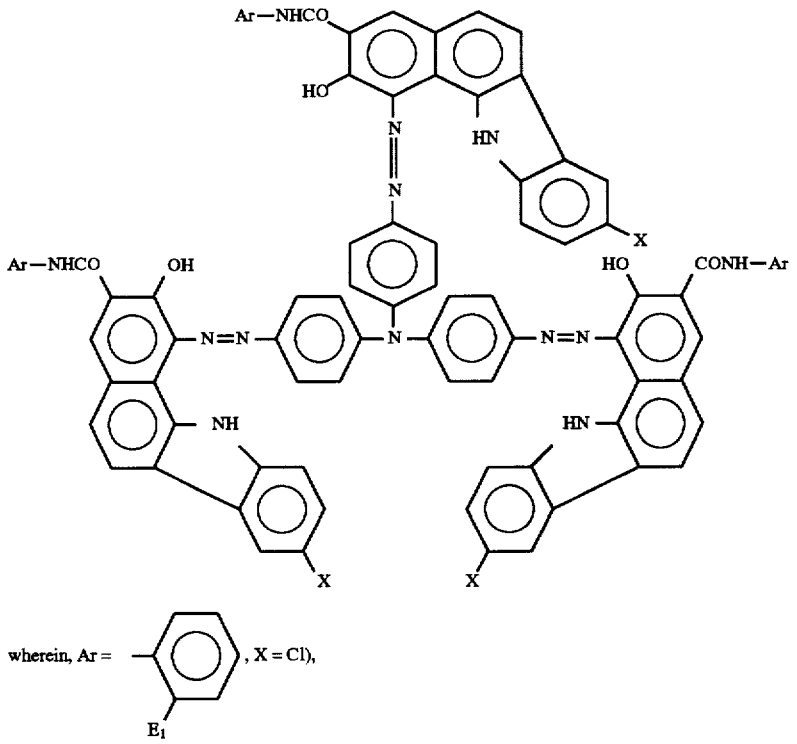

5 parts of polycarbonate resin (bisphenol-A type; Mn: 20,000) and 600 parts of cyclohexanone were dispersed using a sand mill to obtain a charge generation layer coating solution. This coating solution was applied by dip-coating on the above subbing layer 22, followed by drying at 120° C. for 20 minutes to form a 0.15 μm thick charge generation lever 23*a*.

Next, 20 parts of a biphenyl compound represented by the structural formula:

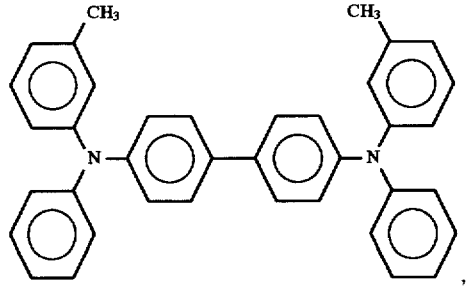

20 parts of polycarbonate resin (bisphenol-A type; Mn: 20,000), 2 parts of fine polytetrafluoroethylene resin (LUPRON L-5, available from Daikin industries, Ltd.) and 800 parts of monochlorobenzene were dispersed using a ball mill to obtain a charge transport layer coating solution. This coating solution was dip-coated on the above charge generation layer 23*a*, followed by drying at 130° C. for 90 minutes to form a 18 μm thick charge transport layer 23*b*.

Next, 2 parts of fine polytetrafluoroethylene resin (LUPRON L-5, available from Daikin Industries, Ltd.), 6 parts of the above biphenyl compound, 12 parts of polycarbonate resin (bisphenol-Z type; Mn: 80,000) and 1,000 parts of dichloromethane were dispersed using a sand mill to obtain a protective layer coating solution. This coating solution was applied by spray coating on the above charge transport layer 23*b*, followed by drying at 120° C. for 30 minutes to form a 6.0 μm thick protective layer 21.

The latent image bearing member produced in the manner described above was further beforehand mechanically abraded using a lapping tape (C-2000, available from Fuji Photo Film Co., Ltd.) so as to have an average surface roughness of 0.3 μm, 1.0 μm or 3.5 μm. In this way, latent image bearing member A (0.3 μm), latent image bearing member B (1.0 μm) and latent image bearing member C (3.5 μm) as shown in FIG. 2 were respectively produced.

Latent Image Bearing Member Production

Example 2

Latent image bearing member D was produced in the same manner as in Latent Image Bearing Member Production Example 1 except that the protective layer provided therein was not formed and the mechanical abrasion carried out therein was omitted. The resulting latent image bearing member D had an average surface roughness of 0.2 μm.

Example 9

To the same colorant-containing resin particles (toner particles) as in Example 1, 1.0% of fine titanium oxide particles I of Synthesis Example 1, 0.5% of cerium oxide with a weight average particle diameter of 1.9 μm and 0.3% of organic resin particles 1 with a weight average particle diameter of 0.065 μm and having two distribution peaks at 0.05 μm and 0.8 μm (quantity of triboelectricity: +55 μc/g) were compounded to give a cyan toner with a weight average particle diameter of 8.4 μm (toner of 5 μm or less: 30% by number).

In this toner, (A):(B) was 3.33:1 and (A):(C) was 2:1.

To such a toner, Cu—Zn—Fe ferrite particles whose surfaces had been coated with a styrene/butyl methacrylate copolymer were added to prepare developer 8 with a toner concentration of 5%.

Images were reproduced using this developer 8 and a commercially available color copying machine (CLC500, manufactured by Canon Inc.) employing the latent image bearing member B having a surface roughness of 1.0 μm as shown in Production Example 1, and evaluation was made.

In the evaluation on the image reproduction, a 40,000 sheet running test was made at a development contrast of 320 V in environments of temperature/humidity 20° C./10% RH, 23° C./65% RH and 30° C./80% RH each, using an original having 50% image area.

As a result, in the present invention, on account of the improvements in the latent image bearing member and the developer, no faulty cleaning occurred at all and image density was stable at 1.4 to 1.6, even after running on 40,000 sheets, to obtain images of the same quality as those at the initial stage also in regard to fogging and sharpness.

Example 10

Developer 9 was prepared in the same manner as in Example 9 except that the cerium oxide used therein was replaced with 0.5% of strontium titanate with a weight average particle diameter of 1.5 μm. Images were reproduced in the same way. As a result, good results were obtained.

In the toner of this developer, (A):(B) was 3.33:1 and (A):(C) was 2:1.

Example 11

Images were reproduced in the same manner as in Example 9 except that the latent image bearing member used therein was replaced with the latent image bearing member A having a surface roughness of 0.3 μm as shown in Production Example 1. As a result, good results were obtained.

Example 12

Developer 10 was prepared in the same manner as in Example 9 except that the fine titanium oxide particles I used therein was replaced with 1.0% of fine titanium oxide particles II prepared in Synthesis Example 2. Images were reproduced in the same way. As a result, good results were obtained.

In the toner of this developer, (A):(B) was 3.33:1 and (A):(C) was 2:1.

Comparative Example 14

Comparative developer 10 was prepared in the same manner as in Example 9 except that the cerium oxide was not used. Images were reproduced in the same way. As a result, in the environment of temperature/humidity 20° C./10% RH, filming appeared at image areas in which toner consumption was relatively large, on about the 2,000th and the following sheets. Then, the drum surface was examined to find that deposits were seen thereon.

In the toner of this developer, (A):(B) was 3.33:1 and (A):(C) was 1:0.

Comparative Example 15

Images were reproduced using the developer 8 in the same manner as in Example 9 except that the latent image bearing member used therein was replaced with the latent image bearing member D shown in Production Example 2. As a result, uneven images appeared at halftone areas on about the 30,000th and the following sheets. Then, the latent image bearing member was examined and uneven scraping was seen.

Comparative Example 16

Images were reproduced using the developer 8 in the same manner as in Example 9 except that the latent image bearing member used therein was replaced with the latent image bearing member C having a surface roughness of 3.5 μm as shown in Production Example 1. As a result, only images having poor highlight reproduction of a photograph original were obtained.

Example 13

Latent image bearing member E having an average surface roughness of 0.3 μm was produced in the same manner as in Latent Image Bearing Member Production Example 1 except that the amount of the fine polytetrafluoroethylene resin (LUPRON L-5, available from Daikin Industries, Ltd.) used to form the protective layer was changed to 6 parts.

Images were reproduced using a commercially available color copying machine (CLC500, manufactured by Canon Inc.) whose cleaning blade was changed with the cleaning blade used in Example 6, having been covered on its surface with a polyamide resin coat layer containing fine carbon fluoride powder, and whose latent image bearing member was exchanged for the latent image bearing member 5 described above, and also using the developer 8 used in Example 9. Evaluation was also made.

In the evaluation on the image reproduction, a 50,000 sheet running test was made at a development contrast of 300 V in environments of temperature/humidity 20° C./10% RH, 23° C./65% RH and 30° C./80% RH each, using an original having 50% image area.

As a result, in the present invention, on account of the improvements in the latent image bearing member and the developer, no faulty cleaning occurred at all and image density was stable at 1.4 to 1.6, even after running on 50,000 sheets, and images of the same quality as those at the initial stage also estimated on fogging and sharpness.

What is claimed is:

1. An image forming method comprising:

(i) forming a toner image using a toner on a latent image bearing member containing an organic photoconductive material; said toner comprising toner particles and external additives, wherein;

said external additives comprise (A) titanium oxide particles having a weight average particle diameter from 0.01 μm to 0.2 μm having been subjected to hydrophobic treatment, (B) organic resin particles having a weight average particle diameter from 0.02 μm to 0.5 μm and having a charge of opposite polarity to the toner particles and (C) inorganic compound particles having a weight average particle diameter from 0.5 μm to 2.5 μm; said inorganic compound particles (C) selected from the group consisting of silica, magnesium oxide, boron nitride, aluminum nitride, carbon nitride, calcium titanate, strontium titanate, barium titanate, magnesium titanate, cerium oxide, zirconium oxide, aluminum oxide, titanium oxide, zinc oxide and calcium carbonate;

said external additives being added in an amount satisfying the relationship:

$(A):(B)=2:1$ to $10:1$ $(A):(C)=1:1$ to $5:1$, and said toner contains toner particles having a particle diameter from 2 μm to 5 μm in an amount from 15% by number to 40% number;

(ii) transferring said toner image to a transfer medium;

(iii) cleaning said latent image bearing member by means of a cleaning member after the transfer;

said cleaning member comprising a resin substrate and, provided on said resin substrate, a polyamide resin coat layer containing low surface free energy fine particles having a weight average particle diameter from 0.15 μm to 2.0 μm; and (iv) repeating steps (i) to (iii) at least once.

2. An image forming method according to claim 1, wherein said toner image is formed by developing a toner, an electrostatic latent image present on said latent image bearing member, using a two-component developer comprised of said toner and magnetic particles.

3. An image forming method according to claim 2, wherein said magnetic particles comprise particles having magnetism in the presence of a magnetic field, comprised of a magnetic metal, an alloy thereof, an oxide thereof or ferrite.

4. An image forming method according to claim 2, wherein said magnetic particles comprise resin-coated magnetic particles.

5. An image forming method according to claim 4, wherein the surfaces of said resin coated magnetic particles have been coated with a resin in a coat weight of from 0.1% by weight to 30% by weight based on the weight of the magnetic particles.

6. An image method according to claim 2, wherein said low surface free energy fine particles have a weight average particle diameter of from 0.15 μm to 1.5 μm.

7. An image forming method according to claim 2, wherein said low surface free energy fine particles comprise a fluorine-containing compound or a silicon-containing compound.

8. An image forming method according to claim 7, wherein said low surface free energy fine particles comprise fine silica powder, fine silica-alumina eutectic powder or silicone resin particles.

9. An image forming method according to claim 8, wherein said low surface free energy fine particles comprise silicone resin particles with a siloxane structure having one alkyl group bonded to the silicon atom.

10. An image forming method according to claim 2, wherein said low surface free energy fine particles comprise carbon fluoride, polytetrafluoroethylene, polyvinylidene fluoride or a tetrafluoroethylene/vinylidene fluoride copolymer.

11. An image forming method according to claim 2, wherein said titanium oxide particles (A) have been subjected to hydrophobic treatment in an aqueous system.

12. An image forming method according to claim 2, wherein said titanium oxide particles (A) have been subjected to hydrophobic treatment using a silane coupling agent represented by the formula (1):

$$R_mSiY_n \quad (1)$$

wherein R is an alkoxy group, m is an integer of 1 to 3, Y is a hydrocarbon group selected from an alkyl group, a vinyl group, a glycidoxy group or a methacrylic group; and n is an integer of 1 to 3.

13. An image forming method according to claim 2, wherein said titanium oxide particles (A) have been subjected to hydrophobic treatment using a silane coupling agent represented by the formula (2):

$$C_nH_{2n+1}—Si—(OC_mH_{2m+1})_3 \quad (2)$$

wherein n is an integer of 4 to 12, and m is an integer of 1 to 3.

14. An image forming method according to claim 2, wherein said titanium oxide particles (A) have been subjected to hydrophobic treatment using a hydrophobicity imparting agent in an amount of from 1 part by weight to 50 parts by weight based on 100 parts by weight of the titanium oxide particles.

15. An image forming method according to claim 2, wherein said titanium oxide particles (A) have been subjected to hydrophobic treatment using a hydrophobicity imparting agent in an amount of from 3 parts by weight to 40 parts by weight based on 100 parts by weight of the titanium oxide particles.

16. An image forming method according to claim 2, wherein said titanium oxide particles (A) have a hydrophobicity of from 40% to 80%.

17. An image forming method according to claim 2, wherein said titanium oxide particles (A) have a hydrophobicity of from 50% to 80%.

18. An image forming method according to claim 2, wherein said titanium oxide particles (A) have a weight average particle diameter of from 0.015 μm to 0.15 μm.

19. An image forming method according to claim 2, wherein said titanium oxide particles (A) have a light transmittance of 40% or more at a light wavelength of 400 nm.

20. An image forming method according to claim 2, wherein said titanium oxide particles (A) have a light transmittance of 50% or more at a light wavelength of 400 nm.

21. An image forming method according to claim 2, wherein said organic resin particles (B) have a weight average particle diameter of from 0.04 μm to 0.4 μm.

22. An image forming method according to claim 2, wherein said organic resin particles (B) have two distribution peaks in the regions of from 0.02 μm to 0.2 μm and from 0.3 μm to 0.8 μm in its particle size distribution.

23. An image forming method according to claim 22, wherein said organic resin particles (B) have a distribution peak in a region of 0.3–0.8 μm of particle diameter in a proportion of from 2% by weight to 20% by weight based on the total areas of its particle size distribution.

24. An image forming method according to claim 22, wherein said organic resin particles (B) have a distribution peak in a region of 0.3–0.8 μm of particle diameter in a proportion of from 3% by weight to 13% by weight based on the total areas of its particle size distribution.

25. An image forming method according to claim 22, wherein said organic resin particles (B) are prepared by dry-process blending or wet-process blending of two kinds of particles having different particle diameters, followed by drying, to have two distribution peaks in particle size distribution.

26. An image forming method according to claim 22, wherein said organic resin particles (B) are prepared by causing primary particles to cohere, when the product is dried from an emulsion after polymerization, to have a particle size distribution having two distribution peaks.

27. An image forming method according to claim 2, wherein said organic resin particles (B) are contained in the toner in an amount of from 0.1% by weight to 5.0% by weight based on the weight of the toner particles.

28. An image forming method according to claim 2, wherein said organic resin particles (B) are contained in the toner in an amount of from 0.15% by weight to 3.0% by weight based on the weight of the toner particles.

29. An image forming method according to claim 2, wherein said organic resin particles (B) comprise a polymer of at least one kind of monomers selected from the group consisting of styrene, a styrene derivative, an addition-polymerizable unsaturated carboxylic acid, a metal salt of an addition-polymerizable unsaturated carboxylic acid, an ester compound of an addition-polymerizable unsaturated carboxylic acid with an alcohol, an amide derived from an addition-polymerizable unsaturated carboxylic acid, a nitrile derived from an addition-polymerizable unsaturated carboxylic acid, an aliphatic monoolefin, a halogenated aliphatic olefin, a conjugated aliphatic diolefin, a vinyl acetate, a vinyl ether and a nitrogen-containing vinyl compound.

30. An image forming method according to claim 2, wherein said organic resin particles (B) have spherical fine particles produced by a process selected from the group consisting of spray drying, suspension polymerization, emulsion polymerization, soap-free polymerization, seed polymerization and mechanical pulverization.

31. An image forming method according to claim 2, wherein said organic resin particles (B) have resin particles produced by soap-free polymerization.

32. An image forming method according to claim 2, wherein said external additives are added in an amount satisfying the relationship:

$$(A):(B)=3:1 \text{ to } 10:1.$$

33. An image forming method according to claim 2, wherein said toner particles comprise colorant-containing resin particles containing at least a colorant and a binder resin.

34. An image forming method according to claim 2, wherein said toner contains toner particles with a particle diameter of from 2 μm to 5 μm in an amount of from 20% by number to 35% by number.

35. An image forming method according to claim 1, wherein said said external additives are added in an amount satisfying the relationship:

$$(A):(B)=3:1 \text{ to } 10:1$$

$$(A):(C)=2:1 \text{ to } 5:1.$$

36. An image forming method according to claim 1, wherein said latent image bearing member comprises a photosensitive layer containing an organic photoconductive material and a protective layer formed on the outer surface of said photosensitive layer;

said protective layer containing fluorine-containing resin particles in an amount of from 5% by weight to 40% by weight based on the total weight of the protective layer.

37. An image forming method according to claim 36, wherein the surface of said latent image bearing member has a 10-point average surface roughness Rz of from 0.1 μm to 2.5 μm.

38. An image forming method according to claim 36, wherein the surface of said latent image bearing member has a 10-point average surface roughness Rz of from 0.1 μm to 1.5 μm.

39. An image forming method according to claim 36, wherein said protective layer contains said fluorine-containing resin particles in an amount of from 10% by weight to 40% by weight based on the total weight of the protective layer.

40. An image forming method according to claim 36, wherein said protective layer has a layer thickness of from 0.05 μm to 8.0 μm.

41. An image forming method according to claim 36, wherein said protective layer has a layer thickness of from 0.5 μm to 6.0 μm.

42. An image forming method according to claim 36, wherein said photosensitive layer contains said fluorine-containing resin particles in an amount of not more than 10% by weight based on the total weight of the photosensitive layer.

43. An image forming method according to claim 36, wherein said photosensitive layer contains said fluorine-containing resin particles in an amount of not more than 7% by weight based on the total weight of the photosensitive layer.

44. An image forming method according to claim 36, wherein said fluorine-containing resin particles have a weight average particle diameter of from 0.01 μm to 10 μm.

45. An image forming method according to claim 36, wherein said fluorine-containing resin particles have a weight average particle diameter of from 0.05 μm to 2.0 μm.

46. An image forming method according to claim 36, wherein said organic photoconductive material comprises a charge-generating material and a charge-transporting material.

47. An image forming method according to claim 36, wherein said protective layer comprises fluorine-containing resin particles dispersed in a binder resin having film forming properties.

48. An image forming method comprising:

(i) forming a toner image using a toner on a latent image bearing member containing an organic photoconductive material;

said latent image bearing member comprising a photosensitive layer containing an organic photoconductive material and a protective layer formed on the outer surface of said photosensitive layer, wherein;

said protective layer contains fluorine-containing resin particles in an amount from 5% by weight to 40% by weight based on the total weight of the protective layer; and said toner comprising toner particles and external additives, wherein, said external additives comprise (A) titanium oxide particles having a weight average particle diameter from 0.01 μm to 0.2 μm having been subjected to hydrophobic treatment, (B) organic resin particles having a weight average particle diameter from 0.02 μm to 0.5 μm and having a charge of opposite polarity to the toner particles, and (C) inorganic compound particles having a weight average particle diameter from 0.5 μm to 2.5 μm, said inorganic compound particles (C) selected from the group consisting of calcium titanate, strontium titanate, barium titanate, magnesium titanate, cerium oxide, zirconium oxide, aluminum oxide, titanium oxide, zinc oxide and calcium carbonate, said external additives being added in an amount satisfying the relationship:

$(A):(B)=2:1$ to $10:1$ $(A):(C)=1:1$ to $5:1$;

and said toner contains toner particles having a particle diameter from 2 μm to 5 μm in an amount from 15% by number to 40% by number;

(ii) transferring said toner image to a transfer medium;

(iii) after the transfer, cleaning said latent image bearing member by means of a cleaning member; and (iv) repeating steps (i) to (iii) at least once.

49. An image forming method according to claim 48, wherein said toner image is formed by developing an electrostatic latent image present on said latent image bearing member, using a two-component developer comprised of said toner and magnetic particles.

50. An image forming method according to claim 49, wherein said magnetic particles comprise particles having magnetism in the presence of a magnetic field, comprised of a magnetic metal, an alloy thereof, an oxide thereof or ferrite.

51. An image forming method according to claim 49, wherein said magnetic particles comprise resin-coated magnetic particles.

52. An image forming method according to claim 51, wherein the surfaces of said resin-coated magnetic particles have been coated with a resin in a coat weight of from 0.1% by weight to 30% by weight based on the weight of the magnetic particles.

53. An image forming method according to claim 49, wherein the surface of said latent image bearing member has a 10-point average surface roughness Rz of from 0.1 μm to 2.5 μm.

54. An image forming method according to claim 49, wherein the surface of said latent image bearing member has a 10-point average surface roughness Rz of from 0.1 μm to 1.5 μm.

55. An image forming method according to claim 49, wherein said protective layer contains said fluorine-containing resin particles in an amount of from 10% by weight to 40% by weight based on the total weight of the protective layer.

56. An image forming method according to claim 49, wherein said protective layer has a layer thickness of from 0.05 μm to 8.0 μm.

57. An image forming method according to claim 49, wherein said protective layer has a layer thickness of from 0.5 μm to 6.0 μm.

58. An image forming method according to claim 49, wherein said photosensitive layer contains said fluorine-containing resin particles in an amount of not more than 10% by weight based on the total weight of the photosensitive layer.

59. An image forming method according to claim 49, wherein said photosensitive layer contains said fluorine-containing resin particles in an amount of not more than 7% by weight based on the total weight of the photosensitive layer.

60. An image forming method according to claim 49, wherein said fluorine-containing resin particles have a weight average particle diameter of from 0.01 μm to 10 μm.

61. An image forming method according to claim 49, wherein said fluorine-containing resin particles have a weight average particle diameter of from 0.05 μm to 2.0 μm.

62. An image forming method according to claim 49, wherein said organic photoconductive material comprises a charge-generating material and a charge-transporting material.

63. An image forming method according to claim 49, wherein said protective layer comprises fluorine-containing resin particles dispersed in a binder resin having film forming properties.

64. An image forming method according to claim 49, wherein said titanium oxide particles (A) have been subjected to hydrophobic treatment in an aqueous system.

65. An image forming method according to claim 49, wherein said titanium oxide particles (A) have been subjected to hydrophobic treatment using a silane coupling agent represented by the formula (1):

$$R_mSiY_n \quad (1)$$

wherein R is an alkoxy group, m is an integer of 1 to 3, Y is a hydrocarbon group selected from an alkyl group, a vinyl group, a glycidoxy group or a methacrylic group; and n is an integer of 1 to 3.

66. An image forming method according to claim 49, wherein said titanium oxide particles (A) have been subjected to hydrophobic treatment using silane coupling agent represented by the formula (2):

$$C_nH_{2n+1}—Si—(OC_mH_{2m+1})_3$$

wherein n is an integer of 4 to 12, and m is an integer of 1 to 3.

67. An image forming method according to claim 49, wherein said titanium oxide particles (A) have been subjected to hydrophobic treatment using a hydrophobicity imparting agent in an amount of from 1 part by weight to 50 parts by weight based on 100 parts by weight of the titanium oxide particles.

68. An image forming method according to claim 49, wherein said titanium oxide particles (A) have been subjected to hydrophobic treatment using a hydrophobicity imparting agent in an amount of from 3 parts by weight to 40 parts by weight based on 100 parts by weight of the titanium oxide particles.

69. An image forming method according to claim 49, wherein said titanium oxide particles (A) have a hydrophobicity of from 40% to 80%.

70. An image forming method according to claim 49, wherein said titanium oxide particles (A) have a hydrophobicity of from 50% to 80%.

71. An image forming method according to claim 49, wherein said titanium oxide particles (A) have a weight average particle diameter of from 0.015 μm to 0.15 μm.

72. An image forming method according to claim 49, wherein said titanium oxide particles (A) have a light transmittance of 40% or more at a light wavelength of 400 μm.

73. An image forming method according to claim 49, wherein said titanium oxide particles (A) have a light transmittance of 50% or more at a light wavelength of 400 μm.

74. An image forming method according to claim 49, wherein said organic resin particles (B) have a weight average particle diameter of from 0.04 μm to 0.4 μm.

75. An image forming method according to claim 49, wherein said organic resin particles (B) have two distribution peaks in the regions of from 0.02 μm to 0.2 μm and from 0.3 μm to 0.8 μm in its particle size distribution.

76. An image forming method according to claim 75, wherein said organic resin particles (B) have a distribution peak in a region of 0.3–0.8 μm of particle diameter in a proportion of from 2% by weight to 20% by weight based on the total areas of its particle size distribution.

77. An image forming method accordance to claim 75, wherein said organic resin particles (B) have a distribution peak in a region of 0.3–0.8 μm of particle diameter in a proportion of from 3% by weight to 13% by weight based on the total areas of its particle size distribution.

78. An image forming method according to claim 49, wherein said organic resin particles (B) are contained in the toner in an amount of from 0.1% by weight to 5.0% by weight based on the weight of the toner particles.

79. An image forming method according to claim 49, wherein said organic resin particles (B) are contained in the toner in an amount of from 0.15% by weight to 3.0% by weight based on the weight of the toner particles.

80. An image forming method according to claim 49, wherein said organic resin particles (B) comprise a polymer of at least one kind of monomers selected from the group consisting of styrene, a substituted styrene, an addition-polymerizable unsaturated carboxylic acid, a metal salt of an addition-polymerizable unsaturated carboxylic acid, an ester compound of an addition-polymerizable unsaturated carboxylic acid with an alcohol, an amide derived from an addition-polymerizable unsaturated carboxylic acid, a nitrile derived from an addition-polymerizable unsaturated carboxylic acid, an aliphatic monoolefin, a halogenated aliphatic olefin, a conjugated aliphatic diolefin, a vinyl acetate, a vinyl ether and a nitrogen-containing vinyl compound.

81. An image forming method according to claim 49, wherein said organic resin particles (B) have spherical fine particles produced by a process selected from the group consisting of spray drying, suspension polymerization, emulsion polymerization, soap-free polymerization, seed polymerization and mechanical pulverization.

82. An image forming method according to claim 49, wherein said organic resin particles (B) have resin particles produced by soap-free polymerization.

83. An image forming method according to claim 75, wherein said organic resin particles (B) are prepared to have two distribution peaks by dry-process blending or wet-process blending of two kinds of particles having different particle diameters, followed by drying.

84. An image forming method according to claim 75, wherein said organic resin particles (B) are prepared to have a particle size distribution having two distribution peaks by causing primary particles to cohere when the product is dried from an emulsion after polymerization.

85. An image forming method according to claim 49, wherein said external additives are added in an amount satisfying the relationship:

$(A):(B)=3:1$ to $10:1$ $(A):(C)=2:1$ to $5:1$.

86. An image forming method according to claim 49, wherein said toner particles comprise colorant-containing resin particles containing at least a colorant and a binder resin.

87. An image forming method according to claim 49, wherein said toner contains toner particles with a particle diameter of from 2 μm to 5 μm in an amount of from 20% by number to 35% by number.

88. An image forming method according to claim 48, wherein the surface of said latent image bearing member has a 10-point average surface roughness Rz of 2.5 μm or less.

89. An image forming method comprising:

(i) forming a toner image using a toner on a latent image bearing member containing an organic photoconductive material;

said toner comprising toner particles and external additives, wherein;

said external additives comprise (A) titanium oxide particles having a weight average particle diameter from 0.01 μm to 0.2 μm having been subjected to hydrophobic treatment, and (B) organic resin particles having a weight average particle diameter from 0.02 μm to 0.5 μm, and (C) inorganic compound particles having a weight average particle diameter from 0.5 μm to 2.5 μm; said inorganic compound particles (C) selected from the group consisting of silica, magnesium oxide, boron nitride, aluminum nitride, carbon nitride, calcium titanate, strontium titanate, barium titanate, magnesium titanate, barium oxide, zirconium oxide, aluminum oxide, titanium oxide, zinc oxide and calcium carbonate;

said external additives being added in an amount satisfying the relationship:

$(A):(B)=2:1$ to $10:1$ $(A):(C)=1:1$ to $5:1$:

and said toner contains toner particles having a particle diameter from 2 μm to 5 μm in an amount from 15% by number to 40% by number;

(ii) transferring said toner image to a transfer medium;

(iii) cleaning said latent image bearing member by means of a cleaning member after the transfer;

said cleaning member comprising a resin substrate and provided on said resin substrate, a polyamide resin coat layer containing low surface free energy fine particles having a weight average particle diameter from 0.15 μm to 2.0 μm; and (iv) repeating steps (i) to (iii) at least once.

90. An image forming method according to claim 89, wherein said toner image is formed by developing with a toner, an electrostatic latent image present on said latent image bearing member employing a two-component developer comprised of said toner and magnetic particles.

91. An image forming method according to claim 90, wherein said magnetic particles comprise particles having magnetism in the presence of a magnetic field, comprised of a magnetic metal, an alloy thereof, an oxide thereof or ferrite.

92. An image forming method according to claim 90, wherein said magnetic particles comprise resin-coated magnetic particles.

93. An image forming method according to claim 90, wherein said low surface free energy fine particles have a weight average particle diameter from 0.15 μm to 1.5 μm.

94. An image forming method according to claim 90, wherein said low surface free energy fine particles comprise a fluorine-containing compound or a silicon-containing compound.

95. An image forming method according to claim 94, wherein said low surface free energy fine particles comprise fine silica powder, fine silica-alumina eutectic powder or silicone resin particles.

96. An image forming method according to claim 95, wherein said low surface free energy fine particles comprise silicone resin particles with a siloxane structure having one alkyl group bonded to the silicon atom.

97. An image forming method according to claim 94, wherein said low surface free energy fine particles comprise carbon fluoride, polytetrafluoroethylidene, polyvinylidene fluoride or a tetrafluoroethylene/vinylidene fluoride copolymer.

98. An image forming method according to claim 90, wherein said titanium oxide particles (A) have been subjected to hydrophobic treatment in an aqueous system.

99. An image forming method according to claim 90, wherein said titanium oxide particles (A) have been subjected to hydrophobic treatment using a silane coupling agent represented by the formula (1):

$$R_mSiY_n \quad (1)$$

wherein R is an alkoxy group, m is an integer of 1 to 3, Y is an alkyl group, a vinyl group, a glycidoxy group or a methacrylic group; and n is an integer of 1 to 3.

100. An image forming method according to claim 90 wherein said titanium oxide particles (A) have been subjected to hydrophobic treatment using a silane coupling agent represented by the formula (2):

$$C_nH_{2n+1}—Si(OC_mH_{2m+1})_3 \quad (2)$$

wherein n is an integer of 4 to 12 and m is an integer of 1 to 3.

101. An image forming method according to claim 90, wherein said titanium oxide particles (A) have a weight average particle diameter from 0.015 μm to 0.15 μm.

102. An image forming method according to claim 90, wherein said titanium oxide particles (A) have a light transmittance of 40% or more at a light wavelength of 400 nm.

103. An image forming method according to claim 90, wherein said organic resin particles (B) have a weight average particle diameter from 0.04 μm to 0.4 μm.

104. An image forming method according to claim 90, wherein said organic resin particles (B) have two distribution peaks in the regions from 0.02 μm to 0.2 μm and from 0.3 μm to 0.8 μm in particle size distribution.

105. An image forming method according to claim 104, wherein said organic resin particles (B) have a distribution peak in a region of 0.3–0.8 μm of particle diameter in a proportion from 2% by weight to 20% by weight based on the total areas of particle size distribution.

106. An image forming method according to claim 90, wherein said organic resin particles (B) are present in the toner in an amount from 0.1% by weight to 5.0% by weight based on the weight of the toner particles.

107. An image forming method according to claim 90, wherein said organic resin particles (B) comprise a polymer of at least one kind of monomers selected from the group consisting of styrene, a substituted styrene, an addition-polymerizable unsaturated carboxylic acid, a metal salt of an addition-polymerizable unsaturated carboxylic acid, an ester compound of an addition-polymerizable unsaturated carboxylic acid with an alcohol, an amide formed from an addition-polymerizable unsaturated carboxylic acid, a nitrile formed from an addition-polymerizable unsaturated carboxylic acid, an aliphatic monoolefin, a halogenated aliphatic olefin, a conjugated aliphatic diolefin, a vinyl acetate, a vinyl ether and a nitrogen-containing vinyl compound.

108. An image forming method according to claim 90, wherein said organic resin particles (B) have spherical fine particles produced by a process selected from the group consisting of spray drying, suspension polymerization, emulsion polymerization, soap-free polymerization, seed polymerization and mechanical pulverization.

109. An image forming method according to claim 90, wherein said organic resin particles (B) have resin particles produced by soap-free polymerization.

110. An image forming method according to claim 104, wherein said organic resin particles (B) are prepared by dry-process blending or wet-process blending of two kinds of particles having different particle diameters, followed by drying, to have two distribution peaks in particle size distribution.

111. An image forming method according to claim 104, wherein said organic resin particles (B) are prepared by causing primary particles to cohere when the product is dried from the state of an emulsion after polymerization, to have a particle size distribution having two distribution peaks.

112. An image forming method according to claim 90, wherein said toner particles comprise colorant-containing resin particles containing at least a colorant and a binder resin.

113. An image forming method according to claim 89, wherein said latent image bearing member comprises a photosensitive layer containing an organic photoconductive material and a protective layer formed on the outer surface of said photosensitive layer;

said protective layer containing fluorine-containing resin particles in an amount from 5% by weight to 40% by weight based on the total weight of the protective layer.

114. An image forming method according to claim 113, wherein said protective layer has a layer thickness from 0.05 μm to 8.0 μm.

115. An image forming method according to claim 113, wherein said protective layer contains said fluorine-containing resin particles in an amount of not more than 10% by weight based on the total weight of the protecive layer.

116. An image forming method according to claim 113, wherein said fluorine-containing resin particles have a weight average particle diameter from 0.01 μm to 10 μm.

117. An image forming method according to claim 113, wherein said organic photoconductive material comprises a charge-generating material and a charge-transporting material.

118. An image forming method according to claim 113, wherein said protective layer comprises fluorine-containing resin particles dispersed in a binder resin having film forming properties.

119. An image forming method according to claim 89, wherein the surface of said latent image bearing member has a 10-point average surface roughness Rz from 0.1 μm to 2.5 μm.

120. An image forming method comprising:

(i) forming a toner image using a toner on a latent image bearing member containing an organic photoconductive material;

said latent image bearing member comprising a photosensitive layer containing an organic photoconductive material and a protective layer formed on the outer surface of said photosensitive layer, wherein;

said protective layer contains fluorine-containing resin particles in an amount from 5% by weight to 40% by weight based on the total weight of the protective layer; and said toner comprising toner particles and external additives, wherein;

said external additives comprise (A) titanium oxide particles having a weight average particle diameter from 0.01 μm to 0.2 μm having been subjected to hydrophobic treatment, (B) organic resin particles having a weight average particle diameter from 0.02 μm to 0.5 μm, and (C) inorganic compound particles having a weight average particle diameter from 0.5 μm to 2.5 μm; said inorganic compound particles (C) selected from the group consisting of calcium titanate, strontium titanate, barium titanate, magnesium titanate, cerium oxide, zirconium oxide, aluminum oxide, titanium oxide, zinc oxide and calcium carbonate, said external additives being added in an amount satisfying the relationship:

$(A):(B)=2:1$ to $10:1$ $(A):(C)=1:1$ to $5:1$;

and said toner contains toner particles having a particle diameter from 2 μm to 5 μm in an amount from 15% by number to 40% by number;

(ii) transferring said toner image to a transfer medium;

(iii) after the transfer, cleaning said latent image bearing member by means of a cleaning member; and (iv) repeating steps (i) to (iii) at least once.

121. An image forming method according to claim 120, wherein said toner image is formed by developing an electrostatic latent image present on said latent image bearing member employing a two-component developer comprised of said toner and magnetic particles.

122. An image forming method according to claim 121, wherein said magnetic particles comprise particles having magnetism in the presence of a magnetic field, comprised of a magnetic metal, an alloy thereof, an oxide thereof or ferrite.

123. An image forming method according to claim 121, wherein said magnetic particles comprise resin-coated magnetic particles.

124. An image forming method according to claim 121, wherein the surface of said latent image bearing member has a 10-point average surface roughness Rz of from 0.1 μm to 2.5 μm.

125. An image forming method according to claim 121, wherein said protective layer has a layer thickness from 0.05 μm to 8.0 μm.

126. An image forming method according to claim 121, wherein said protective layer contains said fluorine-containing resin particles in an amount of not more than 10% by weight based on the total weight of the protective layer.

127. An image forming method according to claim 121, wherein said fluorine-containing resin particles have a weight average particle diameter from 0.01 μm to 10 μm.

128. An image forming method according to claim 121, wherein said organic photoconductive material comprises a charge-generating material and a charge-transporting material.

129. An image forming method according to claim 121, wherein said protective layer comprises fluorine-containing resin particles dispersed in a binder resin having film forming properties.

130. An image forming method according to claim 121, wherein said titanium oxide particles (A) have been subjected to hydrophobic treatment in an aqueous system.

131. An image forming method according to claim 121, wherein said titanium oxide particles (A) have been subjected to hydrophobic treatment using a silane coupling agent represented by the formula (1):

$$R_mSiY_n \quad (1)$$

wherein R is an alkoxy group, m is an integer of 1 to 3, Y is an alkyl group, a vinyl group, a glycidoxy group or a methacrylic group; and n is an integer of 1 to 3.

132. An image forming method according to claim 121, wherein said titanium oxide particles (A) have been subjected to hydrophobic treatment using a silane coupling agent represented by the formula (2):

$$C_nH_{2n+1}—Si—(OC_mH_{2m+1})_3 \quad (2)$$

wherein n is an integer of 4 to 12, and m is an integer of 1 to 3.

133. An image forming method according to claim 121, wherein said titanium oxide particles (A) have a weight average particle diameter from 0.015 μm to 0.15 μm.

134. An image forming method according to claim 121, wherein said titanium oxide particles (A) have a light transmittance of 40% or more at a light wavelength of 400 nm.

135. An image forming method according to claim 121, wherein said organic resin particles (B) have a weight average particle diameter from 0.04 μm to 0.4 μm.

136. An image forming method according to claim 121, wherein said organic resin particles (B) have two distribution peaks in the regions from 0.02 μm to 0.2 μm and from 0.3 μm to 0.8 μm in particle size distribution.

137. An image forming method according to claim 136, wherein said organic resin particles (B) have a distribution peak in a region of 0.3–0.8 μm of particle diameter in a proportion from 2% by weight to 20% by weight based on the total areas of particle size distribution.

138. An image forming method according to claim 136, wherein said organic resin particles (B) are prepared by dry-process blending or wet-process blending of two kinds of particles having different particle diameters, followed by drying, to provide two distribution peaks in particle size distribution.

139. An image forming method according to claim 136, wherein said organic resin particles (B) are prepared to have a particle size distribution having two distribution peaks by causing primary particles to cohere when the product is dried from the state of an emulsion after polymerization.

140. An image forming method according to claim 121, wherein said organic resin particles (B) are present in the toner in an amount from 0.1% by weight to 5.0% by weight based on the weight of the toner particles.

141. An image forming method according to claim 121, wherein said organic resin particles (B) comprise a polymer of at least one kind of monomer selected from the group consisting of styrene, a substituted styrene, an addition-polymerizable unsaturated carboxylic acid, a metal salt of an addition-polymerizable unsaturated carboxylic acid, an ester compound of an addition-polymerizable unsaturated carboxylic acid with an alcohol, an amide formed from an addition-polymerizable unsaturated carboxylic acid, a nitrile formed from an addition-polymerizable unsaturated carboxylic acid, an aliphatic monoolefin, a halogenated aliphatic olefin, a conjugated aliphatic diolefin, a vinyl acetate, a vinyl ether and a nitrogen-containing vinyl compound.

142. An image forming method according to claim 121, wherein said organic resin particles (B) are spherical fine particles produced by a process selected from the group consisting of spray drying, suspension polymerization, emulsion polymerization, soap-free polymerization, seed polymerization and mechanical pulverization.

143. An image forming method according to claim 121, wherein said organic resin particles (B) are resin particles produced by soap-free polymerization.

144. An image forming method according to claim 121, wherein said toner particles comprise colorant-containing resin particles containing at least a colorant and a binder resin.

145. An image forming method according to claim 120, wherein the surface of said latent image bearing member has a 10-point average surface roughness Rz of 2.5 μm or less.

* * * * *

UNITED STATES PATENT AND TRADEMARK OFFICE

CERTIFICATE OF CORRECTION

PATENT NO. : 5,733,702

DATED : March 31, 1998

INVENTOR(S) : KENJI OKADO ET AL.

It is certified that error appears in the above-identified patent and that said Letters Patent is hereby corrected as shown below:

COLUMN 1

Line 55, "mathacrylic" should read --methacrylic--.

COLUMN 2

Line 37, "has" should read --have--;
Line 39, "usual" should be deleted;
Line 41, "at the" should read --with respect to fine detail.--; and
Line 42, "minute part." should be deleted.

COLUMN 3

Line 22, "develop" should read --developing--;
Line 28, "less as 15% by" should read --little as 15% in--;
Line 42, "on" should read --of--; and
Line 54, "as" should be deleted.

COLUMN 4

Line 6, "maintain" should read --maintains--.

COLUMN 7

Line 45, "preferable" should read --preferably, the--; and
Line 60, "hydrophocbic" should read --hydrophobic--.

UNITED STATES PATENT AND TRADEMARK OFFICE

CERTIFICATE OF CORRECTION

PATENT NO. : 5,733,702

DATED : March 31, 1998

INVENTOR(S) : KENJI OKADO ET AL.

It is certified that error appears in the above-identified patent and that said Letters Patent is hereby corrected as shown below:

COLUMN 8

Line 5, "particls" should read --particles-- and "cohere" should read --cohere with--;
Line 10, "that" should be deleted;
Line 12, "hyrolyzing" should read --hydrolyzing-- and "agent" should read --agent,--;
Line 13, "less cohere" should read --cohere less with--;
Line 16, "in the state of" should read --as well.--;
Line 17, "primary particles." should be deleted;
Line 45, "vinyltriacethoxysilane" should read --vinyltriacetoxysilane--;
Line 63, "more cohere" should read --cohere more with--; and
Line 65, "may" should be deleted.

COLUMN 9

Line 7, "mope" should read --more--;
Line 11, "hard-wear" should read --hardware--;
Line 39, "has" should read --have--; and
Line 57, "has" should read --having--.

COLUMN 10

Line 2, "in the state" should read --to a state in which--; and
Line 54, "toner" should read --toner particles--.

COLUMN 11

Line 42, "buryl" should read --butyl--; and
Line 56, "butane" should read --butene--, and "orefin" should read --olefin--.

UNITED STATES PATENT AND TRADEMARK OFFICE

CERTIFICATE OF CORRECTION

PATENT NO. : 5,733,702

DATED : March 31, 1998

INVENTOR(S) : KENJI OKADO ET AL.

It is certified that error appears in the above-identified patent and that said Letters Patent is hereby corrected as shown below:

COLUMN 13

Line 7, "be" should be deleted;
Line 15, "in" should read --be added in--; and
Line 19, "has a ration" should read --have a ratio--.

COLUMN 14

Line 15, "widely" should be deleted;
Line 32, "mode" should read --more--;
Line 33, "toned" should read --toner--;
Line 37, "toned" should read --toner--; and
Line 67, "for which smooth surface is readily" should read --the surfaces of which are readily made smooth--.

COLUMN 15

Line 1, "bestowed," should be deleted;
Line 28, "surface" should read --the surface--; and
Line 51, "poly/vinylidene" should read --polyvinylidene--.

COLUMN 16

Line 7, "is" should read --are--;
Line 10, "remained" should read --remaining--; and
Line 14, "and" should be deleted.

COLUMN 17

Line 15, "polychlorotrifluoroethlene" should read --polychlorotrifluoroethylene--;
Line 25, "10 μm" should read --10 μm,--; and
Line 49, "respective" should read --respectively--.

UNITED STATES PATENT AND TRADEMARK OFFICE

CERTIFICATE OF CORRECTION

PATENT NO. : 5,733,702

DATED : March 31, 1998

INVENTOR(S) : KENJI OKADO ET AL.

It is certified that error appears in the above-identified patent and that said Letters Patent is hereby corrected as shown below:

COLUMN 18

Line 50, "artitor" should read --attritor--; and
Line 66, "Inc." should read --Inc.)--.

COLUMN 19

Line 46, "are" should read --is--.

COLUMN 20

Line 3, "manufacture" should read --manufactured--;
Line 25, "to" should be deleted;
Line 46, "cooled" should read --cooling--; and
Line 66, "was" should read --were--.

COLUMN 22

Line 38, "images" should read --Images--.

COLUMN 23

Line 11, "is" should read --were--;
Line 14, "methacrylate/buryl" should read --methacrylate/butyl--;
Line 39, "was" should read --were--;
Line 47, "was" should read --were--;
Line 59, "was" should read --were--; and
Line 61, "resultS" should read --results--.

UNITED STATES PATENT AND TRADEMARK OFFICE

CERTIFICATE OF CORRECTION

PATENT NO. : 5,733,702

DATED : March 31, 1998

INVENTOR(S) : KENJI OKADO ET AL.

It is certified that error appears in the above-identified patent and that said Letters Patent is hereby corrected as shown below:

COLUMN 24

Line 34, "was" should read --were--.

COLUMN 25

Line 37, "$E_1$" should read --$E_t$--.

COLUMN 28

Line 53, "also estimated on" should read --were obtained with respect to--.

COLUMN 29

Line 45, "image" should read --image forming--.

COLUMN 31

Line 21, "styrene derivative," should read --substituted styrene,--.

COLUMN 37

Line 5, "claim 94," should read --claim 90,--.

UNITED STATES PATENT AND TRADEMARK OFFICE

CERTIFICATE OF CORRECTION

PATENT NO. : 5,733,702

DATED : March 31, 1998

INVENTOR(S) : KENJI OKADO ET AL.

It is certified that error appears in the above-identified patent and that said Letters Patent is hereby corrected as shown below:

COLUMN 38

Line 37, "protecive" should read --protective--.

Signed and Sealed this

Fifth Day of January, 1999

*Attest:*

*Attesting Officer*

*Acting Commissioner of Patents and Trademarks*